US007329019B2

(12) United States Patent
Cheung

(10) Patent No.: US 7,329,019 B2
(45) Date of Patent: Feb. 12, 2008

(54) CLOTHING OR FOOTWEAR ILLUMINATION SYSTEM HAVING ELECTRO-LUMINESCENT AND LED LIGHT SOURCES

(76) Inventor: James Cheung, 16 Mount Bethel Rd., #354, Warren, NJ (US) 07059

( * ) Notice: Subject to any disclaimer, the term of this patent is extended or adjusted under 35 U.S.C. 154(b) by 0 days.

(21) Appl. No.: 10/939,134

(22) Filed: Sep. 10, 2004

(65) Prior Publication Data

US 2005/0207138 A1 Sep. 22, 2005

Related U.S. Application Data

(63) Continuation-in-part of application No. 10/321,739, filed on Dec. 17, 2002, now Pat. No. 6,843,578.

(51) Int. Cl.
*F21V 21/08* (2006.01)
*H01H 35/14* (2006.01)

(52) U.S. Cl. ..... 362/103; 362/228; 362/251; 362/84; 362/802; 36/137; 200/61.45 R

(58) Field of Classification Search ..... 362/251, 362/234, 84, 103, 108, 183, 217, 642, 227, 362/276, 394, 395, 457, 800, 802, 228; 36/137; 315/76; 200/61.45 R
See application file for complete search history.

(56) References Cited

U.S. PATENT DOCUMENTS

| | | | | |
|---|---|---|---|---|
| 4,158,922 | A * | 6/1979 | Dana, III | 362/103 |
| 4,860,177 | A * | 8/1989 | Simms | 362/473 |
| 4,949,228 | A * | 8/1990 | Lin et al. | 362/473 |
| 5,381,615 | A * | 1/1995 | MacMillan | 36/137 |
| 5,483,759 | A * | 1/1996 | Silverman | 36/137 |
| 5,599,088 | A * | 2/1997 | Chien | 362/103 |
| 5,803,574 | A * | 9/1998 | Szaniszlo | 362/473 |
| 5,903,103 | A * | 5/1999 | Garner | 315/76 |
| 6,164,794 | A * | 12/2000 | Rodgers | 362/103 |
| 2004/0103563 | A1 * | 6/2004 | Linge | 36/137 |

* cited by examiner

*Primary Examiner*—Jong-Suk (James) Lee
*Assistant Examiner*—Ismael Negron
(74) *Attorney, Agent, or Firm*—Kaliko & Yeager; Scott H. Kaliko

(57) ABSTRACT

An system for illuminating clothing and footwear, utilizing electro-luminescent light strips and LEDs, which are randomly illuminated according to the movement of the person wearing the article(s). In one embodiment illumination control is accomplished by a direct-current to alternating-current converter means and various types of switches. These switches may include a random pressure switch, a random or controlled sequencer, an orbiter random motion switch, or any suitable switch or combination thereof.

38 Claims, 23 Drawing Sheets

CLOTHING OR FOOTWEAR ILLUMINATION SYSTEM HAVING ELECTRO-LUMINESCENT AND LED LIGHT SOURCES

RELATED APPLICATIONS

This is a Continuation-In-Part of U.S. patent application Ser. No. 10/321,739, filed Dec. 17, 2002 now U.S. Pat. No. 6,843,578.

BACKGROUND OF THE INVENTION

The present invention relates generally to illuminated clothing or footwear. More specifically, the present invention relates to an illuminated clothing or footwear system utilizing electro-luminescent (EL) light strips and LEDs with multiple images that are randomly illuminated according to the movement of a person wearing the article by means of a contact switch having multiple contact points that activate circuits to the EL strips and/or LEDs during said movement.

There are many prior art devices exhibiting the use of LEDs and Electro Luminesce (EL) lighting used for clothing articles and footwear producing light flashes based on motion and pressure switches. Concerning footwear, the use of LEDs is well known producing bright and colorful visual effects that are visible from a distance and in semi-bright environments. The disadvantage of the LED is in the lack of design and creativity that can be incorporated into footwear due to the physical characteristic of LEDs and the limitation imposed by footwear. Use of LED's in footwear is primarily restricted to placement within the bottom sole or through portholes of the upper area of the footwear.

On the other hand, EL is substantially flat and pliable producing an advantage over LEDs having the ability of being shaped into or part of artwork. However, unlike the LED that only needs 3-6 volts, EL requires from 200-300 volts for illumination. In addition, EL has a lower luminescence that LED's. EL luminescence is barely visible under basic indoor incandescent or fluorescent light and in outdoor sun light EL would not be visible at all. Therefore, the use of EL in footwear poses no serious challenge to LEDs due to its lower luminescence and greater power requirements.

The present invention attempts to solve this problem by combining the two types of lighting EL and LED into one unit. The use of a motion switch would activate on each movement of the wearer, closing the switch allowing the power source to illuminate each connected LED. Where the EL is connected, the power source would be boosted through an inverter converting the direct current to alternating current to the need voltage to illuminate the EL. The order of the EL and LED illumination would be determined by the visual effect of the lighting and the design of the footwear. The power source and inverter for the EL would be arranged according to this order.

As an additional element, the present invention incorporates a control mechanism to preserve battery life, since the greater power requirements of the EL would drain the battery life faster than LED. The control mechanism may, for example, be the incorporation of a light-sensitive sensor for engaging and disengaging the EL strips not only with the motion sensor but also according to ambient light luminescence, thereby conserving battery life.

SUMMARY OF THE PRESENT INVENTION

A object of the present invention is to provide footwear or clothing illuminated by one or more electro-luminescent (EL) panels.

Another object of the present invention is to provide electro-luminescent clothing or footwear that is switch activated.

Still another object of the present invention is to provide electro-luminescent clothing or footwear wherein said switch may be enabled and disabled manually or in response to movement or pressure.

Yet another object of the present invention is to provide electro-luminescent clothing or footwear having a plurality of EL panels contiguous to the surface area of the article and randomly illuminated by a random motion switch or random pressure switch in response to actions performed by the wearer of the shoe.

Still yet another object of the present invention is to provide electro-luminescent clothing or footwear having a series of EL panels having graphic designs thereon that when lit in series simulate the motion or animation thereof.

A further object of the present invention is to provide electro-luminescent clothing or footwear that is inexpensive to manufacture and operate.

Still a further object of the present invention is to provide electro-luminescent clothing or footwear that is simple to use.

The present invention incorporates one or more LEDs and EL strips as illuminable lighting elements forming a light display for an electronic circuit having a D.C. power supply, a D.C. to A.C. inverter, a motion sensor, and optionally a light-sensitive sensor. The electronic circuit may be attachable or incorporated into an article worn by a user with the motion sensor incorporating at least one mechanical member responsive to user movement causing a first conductive contact of said circuit to contact at least one of a plurality of second conductive contacts creating a closed circuit for the second conductive contact illuminable lighting elements causing illumination until said mechanical responsive member disengages said conductive contacts in response to further movement.

In one embodiment of the present invention, the motion responsive mechanical member may be at least one spring having one distal end connected to a static structure and the other end connected to the first conductive contact. The optional light-sensitive sensor may be incorporated into said electronic circuit to conserve power by causing an open circuit for the EL strips within said circuit when the ambient luminescence would make the EL strips visually ineffective.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
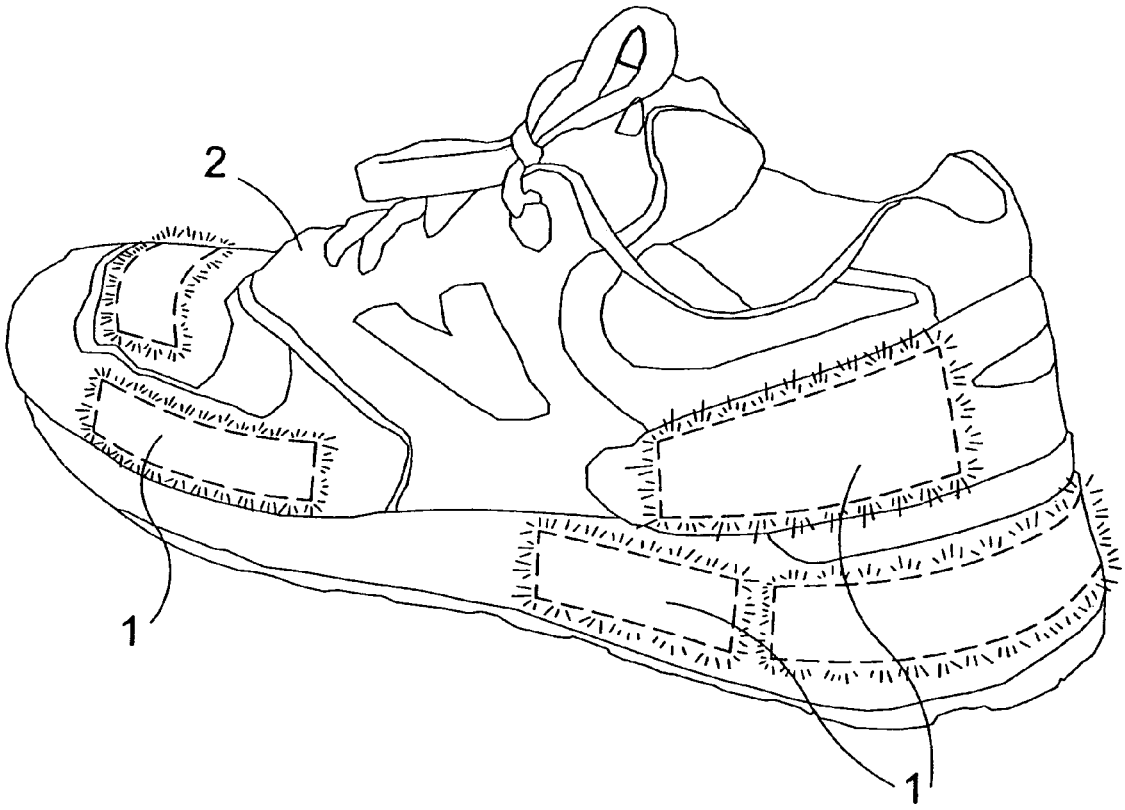
FIG. 1 is a perspective view of the present invention in use.

Turning now descriptively to the drawings, in which similar reference characters denote similar elements throughout the several views, the figures illustrate the present invention. With regard to the reference numerals used, the following numbering is used throughout the various drawing figures.

100 random pressure switch
200 random orbiter motion pressure switch
P applied pressure
C electrical contact
E electrical power out
1 EL light strip
2 shoe
3 EL letter graphic
4 EL star graphic
5 letter graphics
6 star graphics
7A star graphic switch
7B letter graphic switch
8A EL star graphic electrodes
8B EL letter graphic electrodes
9 DC/AC converter
10 battery
11 individual EL star graphic light strips
12 individual EL star graphic electrodes
13 random pressure switch
14 power source
15 control switch
16 power-in electrode
17 conductive pressure plate
18 distribution plate
19 conductive spring
20 contact plate
21 power-out electrodes
22 insulator sleeve
23 electrical leads
24 electrical terminals
25 spring coil retainer clip
26A, 26B, 26C, 26D on/off switches
27 star sequencer
28 letter sequencer
29 individual letter graphic EL strips
30A, 30B, 30C, 30D sequencers
31 random motion switch
32, 33, 34, 35 steps of a sequencer control
36. non-conductive base plate
37 contact plate
38 spring anchor
39 power-in electrode
40 power-out electrode
41 orbiter spring
42 orbiter
43 distribution plate
43B bottom surface of distribution plate
44 bottom surface printed circuit connections
45 orbiter contact shoe
46 orbiter friction shoe
47 orbiter frame
48 orbiter contact shoe internal spring
49 supplemental LED's
50 function interpreter
51 LED lighting
52 LED lighting display
53 EL lighting display
54 EL/LED lighting display
55 light-sensitive sensor
56 light sensor switch
57 EL lighting circuit
58 EL lighting enabled
59 light-sensitive sensor setting
60 EL lighting open circuit
61 EL lighting closed circuit

DESCRIPTION OF THE DRAWING FIGURES

FIG. 1 is an illustrative view of a preferred embodiment of the present invention. The present invention may incorporate electro-luminescent (EL) light strips 1 for various display effects. EL light strips 1 may be used to create many different colors and shapes. In addition, various decorations and graphic elements may be glued and/or printed to an EL surface. In thin strip forms, EL strips 1 may be formed into various shapes and may be removably and/or fixedly attached to articles of clothing, footwear, headwear, etc. FIG. 1, shows shoe 2 having various EL light strips 1 attached.

Figure 2:
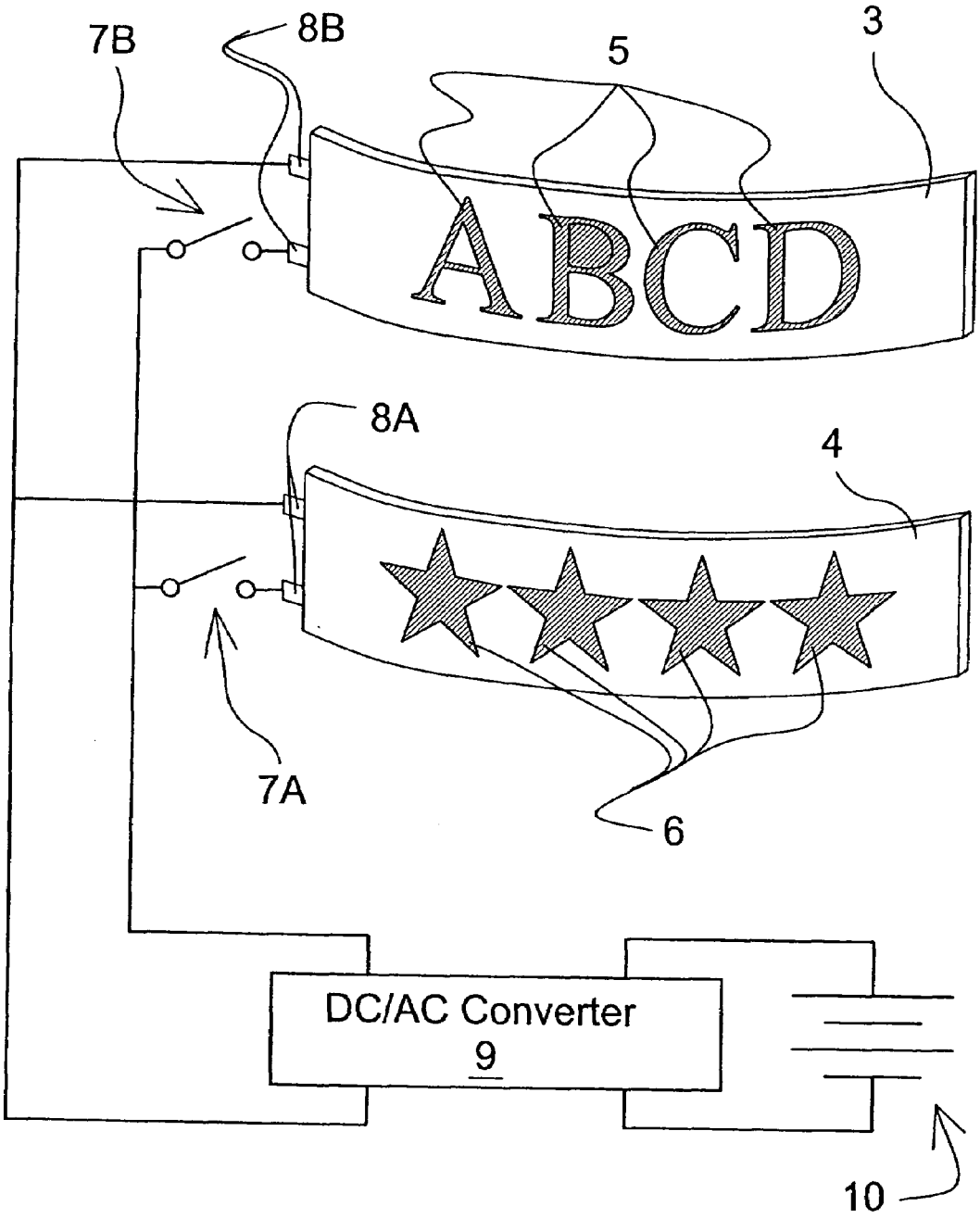
FIG. 2 is a schematic illustration of typical El strips connected to a random pressure switch.

FIG. 2 is a schematic illustration of typical EL strips connected to random pressure switch 13. Individual EL star graphic strip 4 and EL letter graphic 3 may have various solid or textured colors and may utilize other shapes besides star graphic elements 6 or letter graphic elements 5 that are depicted. Each of the EL strips may bear any mixture of a plurality of graphic elements. As shown, EL letter graphic 3 and EL star graphic 4 each have one electrode 8A, 8B connected to one output of DC/AC converter 9 and the other respective electrode 8A, 8B connected to input switch 7A, 7B respectively. Converting DC battery source 10 inputs to DC/AC converter 9 that amplifies input voltage and outputs the required AC current to each EL strip when switch 7A or 7B (or both) are closed.

Figure 3:
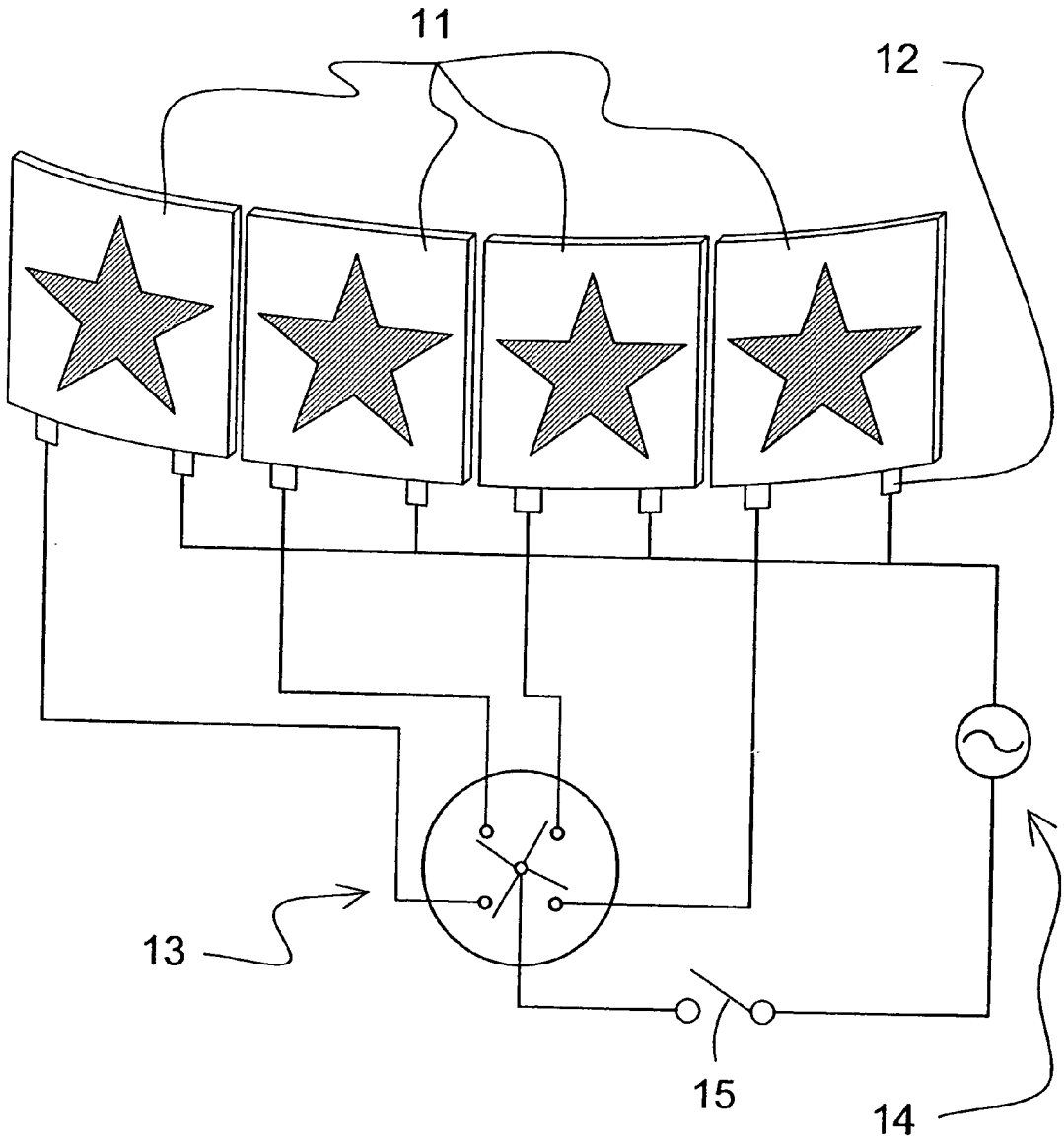
FIG. 3 is a schematic illustration of individual EL star graphic light strips of the present invention hooked to a random pressure switch.

FIG. 3 is a schematic illustration of individual EL star graphic light strips 11 of the present invention hooked to random pressure switch 13. EL star graphic light strips 11 may be directly connected to the random pressure switch 13 thus making the lighting of EL star graphic light strips completely random. Control switch 15 may be opened to disable EL lighting effects. Random pressure switch 13 may also turn on more than one EL strip at a time for various effects. The preferred embodiment of random pressure switch 13 is to use random pressure switch 100 as described below in FIG. 4.

Figure 4:
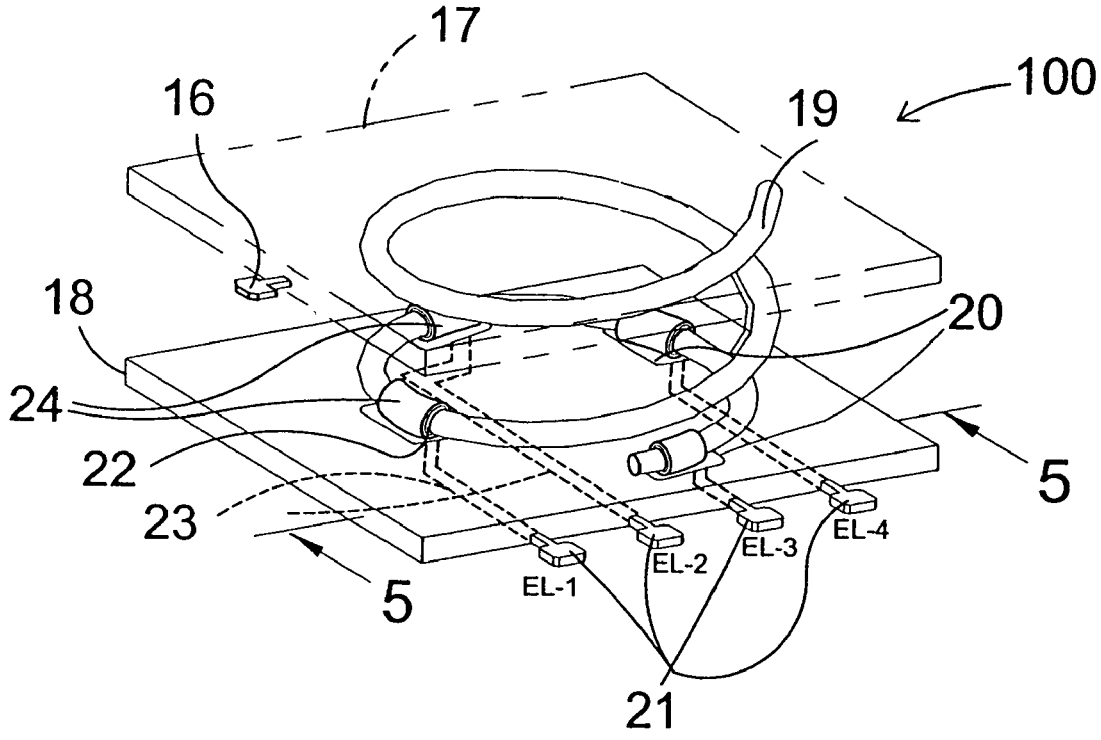
FIG. 4 is a frontal perspective view of a random pressure switch, the preferred embodiment.

FIG. 4 is a front perspective view of a preferred embodiment of random pressure switch 100. Random pressure switch 100 is an assembly that utilizes a conventional conductive spring 19 clement that has a plurality of contact points to complete circuits to various EL strips as pressure is applied thereto during movement of the user thereby causing conductive spring 19 element to flex accordingly and to illuminate the corresponding EL strip. Any appropriate spring oriented random contact switch may be used and the present invention is in no way limited to the switches illustrated in the drawings. FIG. 4 shows conductive spring 19 with the top portion thereof attached to a conductive pressure plate 17 and the lower portion fastened to distribution plate 18 but not in direct contact therewith due to a plurality of spaced, insulated sleeve members 22 and electric terminals 24 concentrically placed thereon. Electric terminals 24 are seated on contact plates 20 having electrical leads 23 communicating with power-out electrodes 21 (also referred to as conductive contacts) for each respective EL strip (not shown) to be attached. Power is brought into conductive pressure plate 17 at power-in electrode 16, also reftrred to as a conductive contact.

Figure 5:
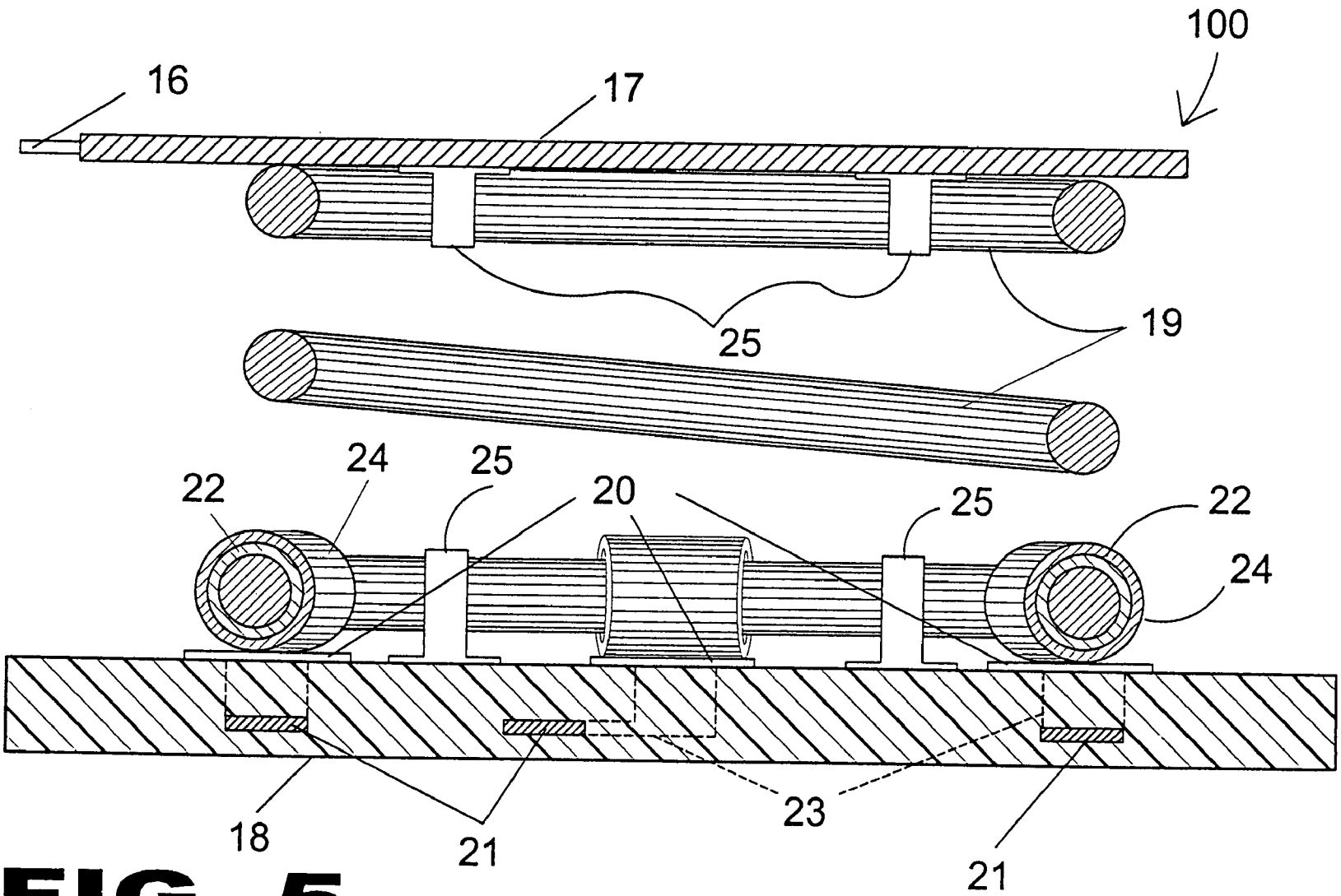
FIG. 5 is a cross sectional side view of a static random pressure switch taken from FIG. 4 as indicated.

FIG. 5 is a cross sectional side view of random pressure switch 100 taken along plane 5-5 of FIG. 4. FIG. 5 shows power-in electrode 16 that supplies power to conductive pressure plate 17. Also shown is spring coil retainer clips 25 that hold conductive spring 19 into position with respect to conductive plate 17 and distribution plate 18. Insulator sleeves 22 are located between conductive spring 19 and electrical terminals 24 at each contact plate 20 functioning to isolate conductive leads 23 and power-out electrodes 21 when conductive spring 19 is in a neutral (non-pressure) position.

Figure 6:
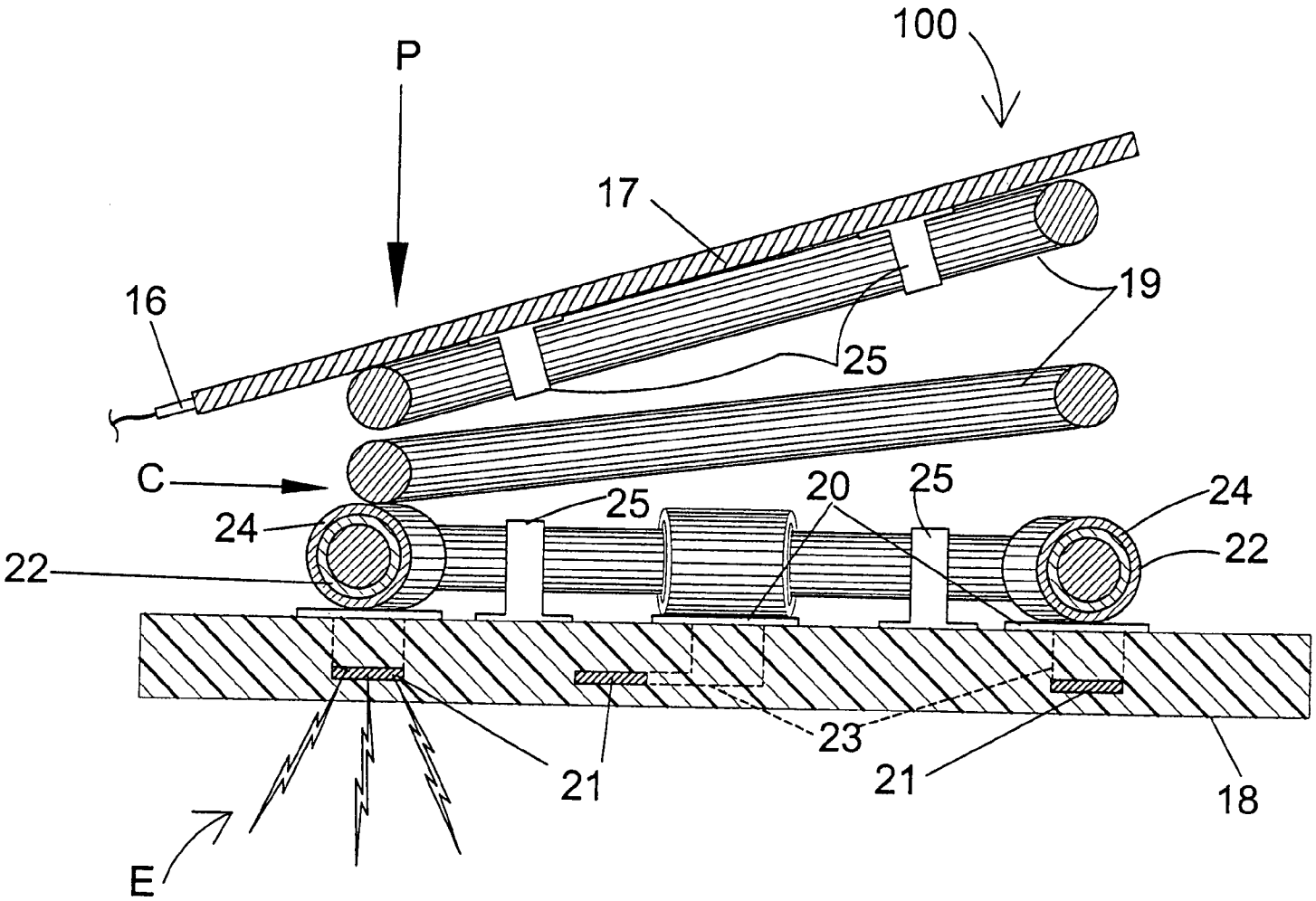
FIG. 6 is a cross sectional side view of a pressure activated random pressure switch.

FIG. 6 is a cross sectional side view of a random pressure switch 100 with pressure P applied. With pressure P applied to conductive pressure plate 17 conductive spring 19 is shown flexed (or deformed) from a non-pressure position such that electrical connection C is made between conductive spring 19 and electrical terminal 24 thus completing an electrical circuit from power-in electrode 16 to power-out electrode 21 where power E is supplied to illuminate at least one external EL light strip.

Figure 7:
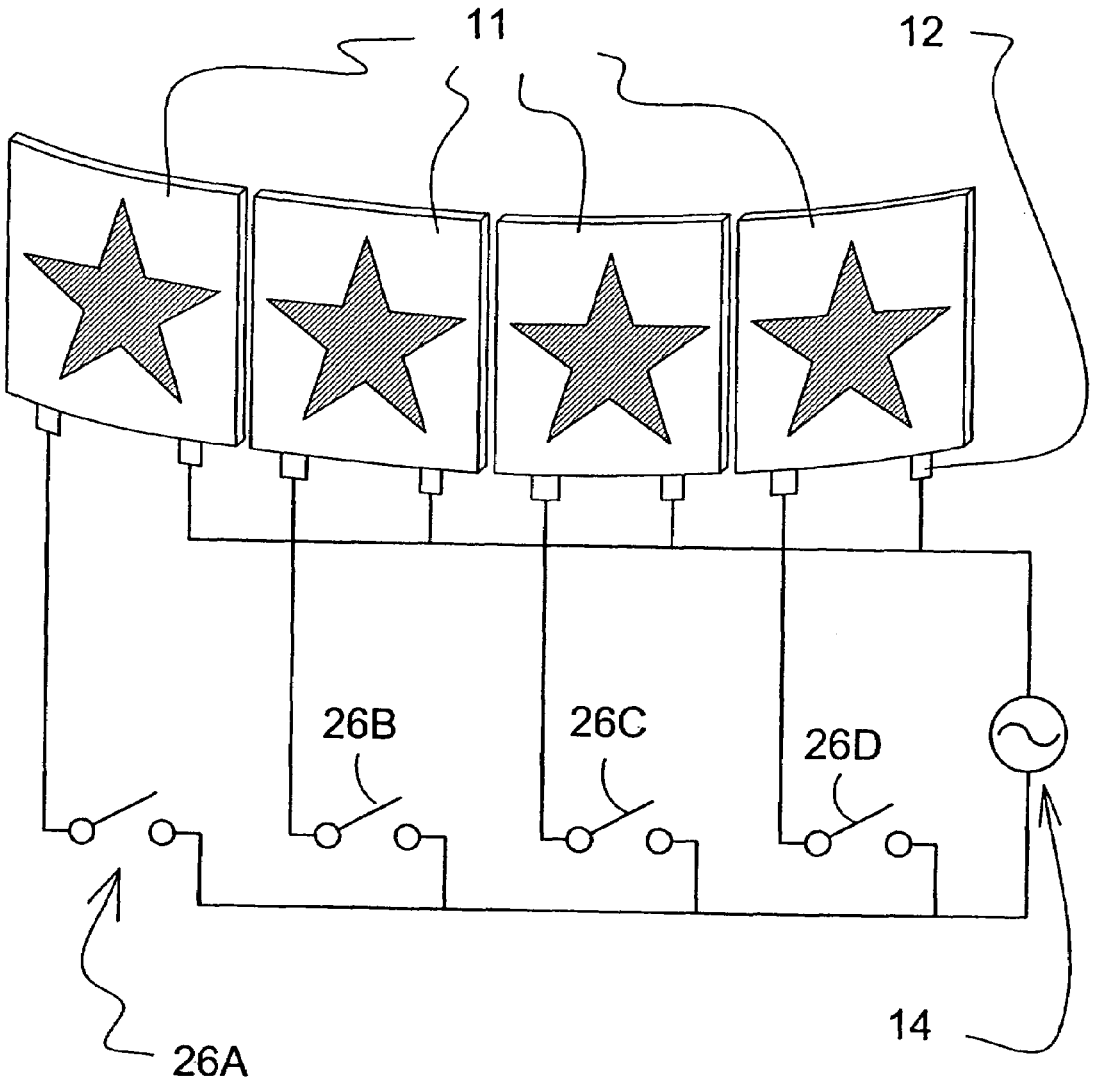
FIG. 7 is a schematic wiring diagram of a series separately switched EL strips.

FIG. 7 is a schematic wiring diagram of a separately switched series of EL strips 11. EL strips 11 may be placed contiguously and switched on and off in a series to create visual effects. This may, for example, give an illusion of movement from one graphic element to another as EL strips 11 are switched on and off. This type of lighting sequence may be accomplished by a preset electrical sequencing circuit to activate/deactivate switches 26A, 26B, 26C, 26D that may supply power from power source 14 to electrodes 12 of each individual EL strip 11. Multiple sequencing circuits may be employed for various types of EL strips. Such multiple sequencing circuits, in turn, may be initiated by another sequencing circuit, or by a random event. A series of EL strips may be lighted by random events directly for different visual effects.

Figure 8:
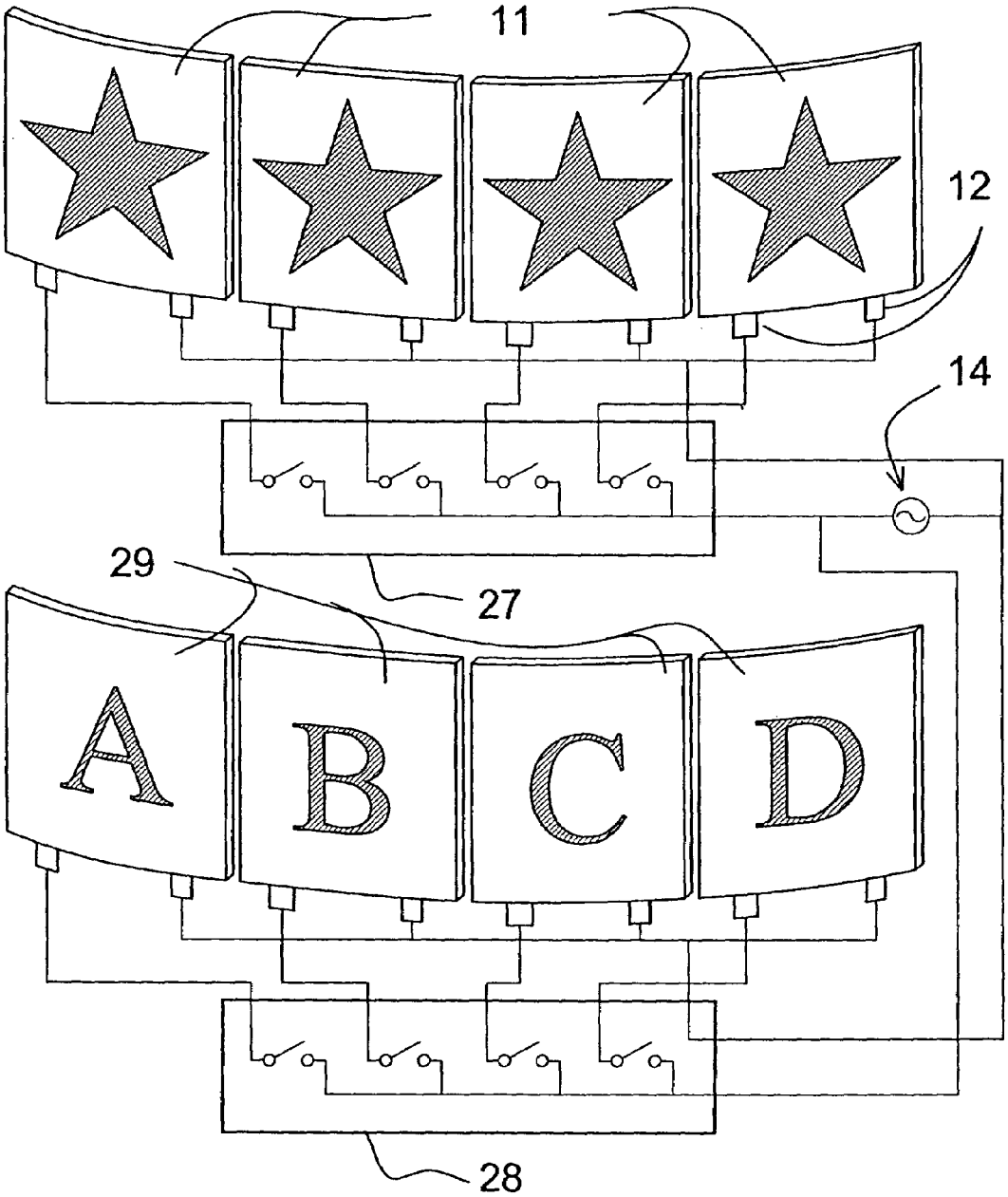
FIG. 8 is a schematic wiring diagram of the use of multiple sequencing circuits.

FIG. 8 is a schematic wiring diagram of the use of multiple sequencing circuits. A number of preset sequencing circuits (sequencers) can be employed to light a series of EL strips for visual effects. In this case, each of the sequencers will repeat a predetermined switching routine at predetermined intervals. Star sequencer 27 logically controls four individual switches going to each star graphic EL strip 11 whereas letter sequencer 28 controls four individual internal switches connecting to letter graphic EL strip 29. It should be noted that although two sequencers are shown, the schematic of FIG. 8 may easily be extended to any multiple of sequencers and any multiple of EL elements. However, in certain instances, such flash patterns may quickly become routine and boring. The present invention overcomes this type of shortcoming by introducing randomness and responsiveness based on the movement of a wearer, which is discussed below.

Figure 9:
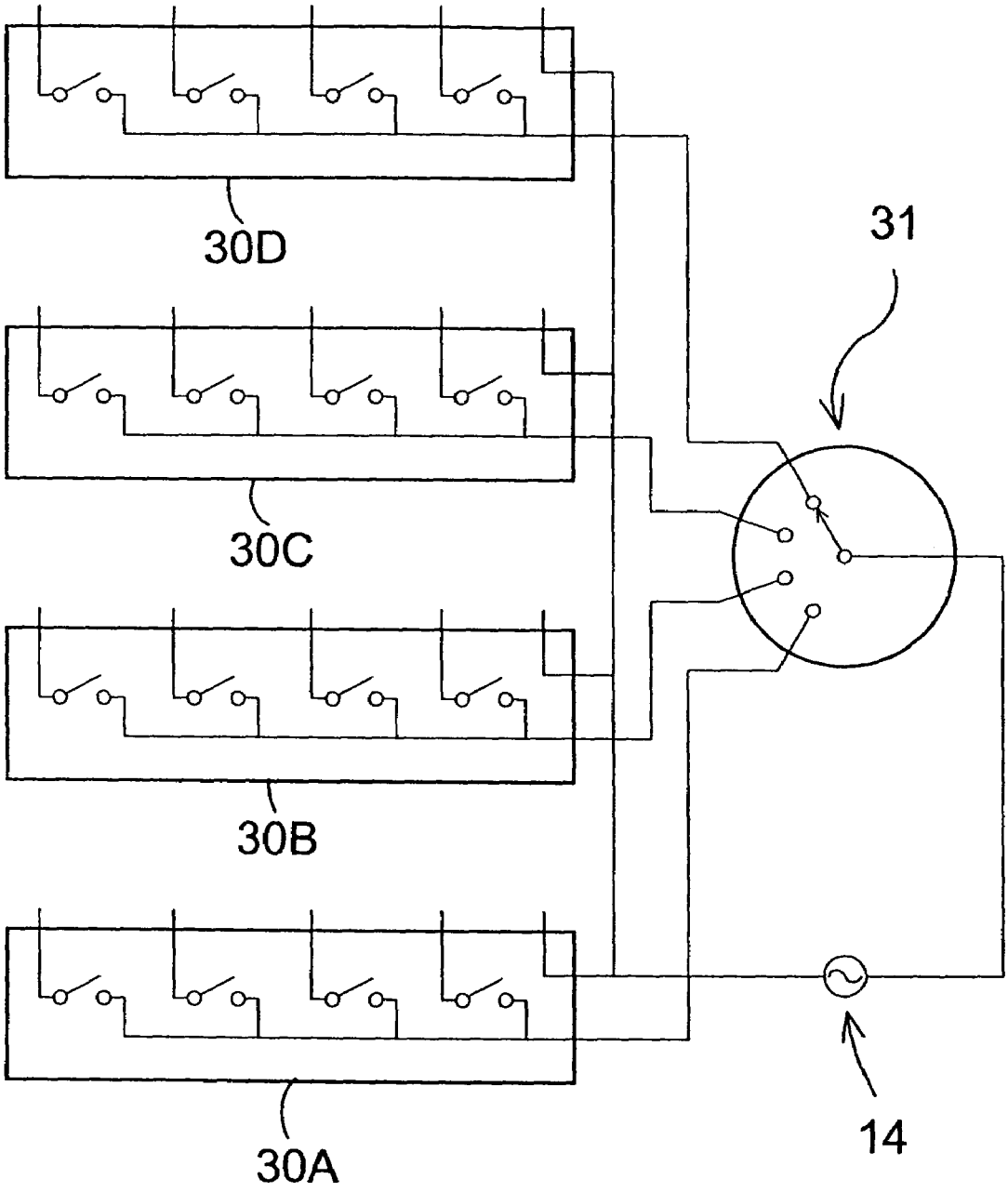
FIG. 9 is a schematic wiring diagram of a use of the present invention with random control of switching sequencers.

FIG. 9 is a schematic wiring diagram of a preferred embodiment of the present invention with random control of switching sequencers 30A, 30B, 30C, and 30D. Group of sequencers 30A, 30B, 30C, 30D may be each initiated randomly by random motion switch 31 to start a series of predetermined switching routines bringing power 14 to EL strips via sequencer outputs instead of repeating such routines endlessly. Once a routine is finished, the respective sequencer will be ready to be initiated again by random motion switch 31. This gives indefinite variety of unexpected and responsive visual effects based on the user's motion. It should be noted that although four sequencers are shown, each with four internal switches, any multiple of sequencers can be used with each sequencer controlling any multiple of internal switches.

Figure 10:
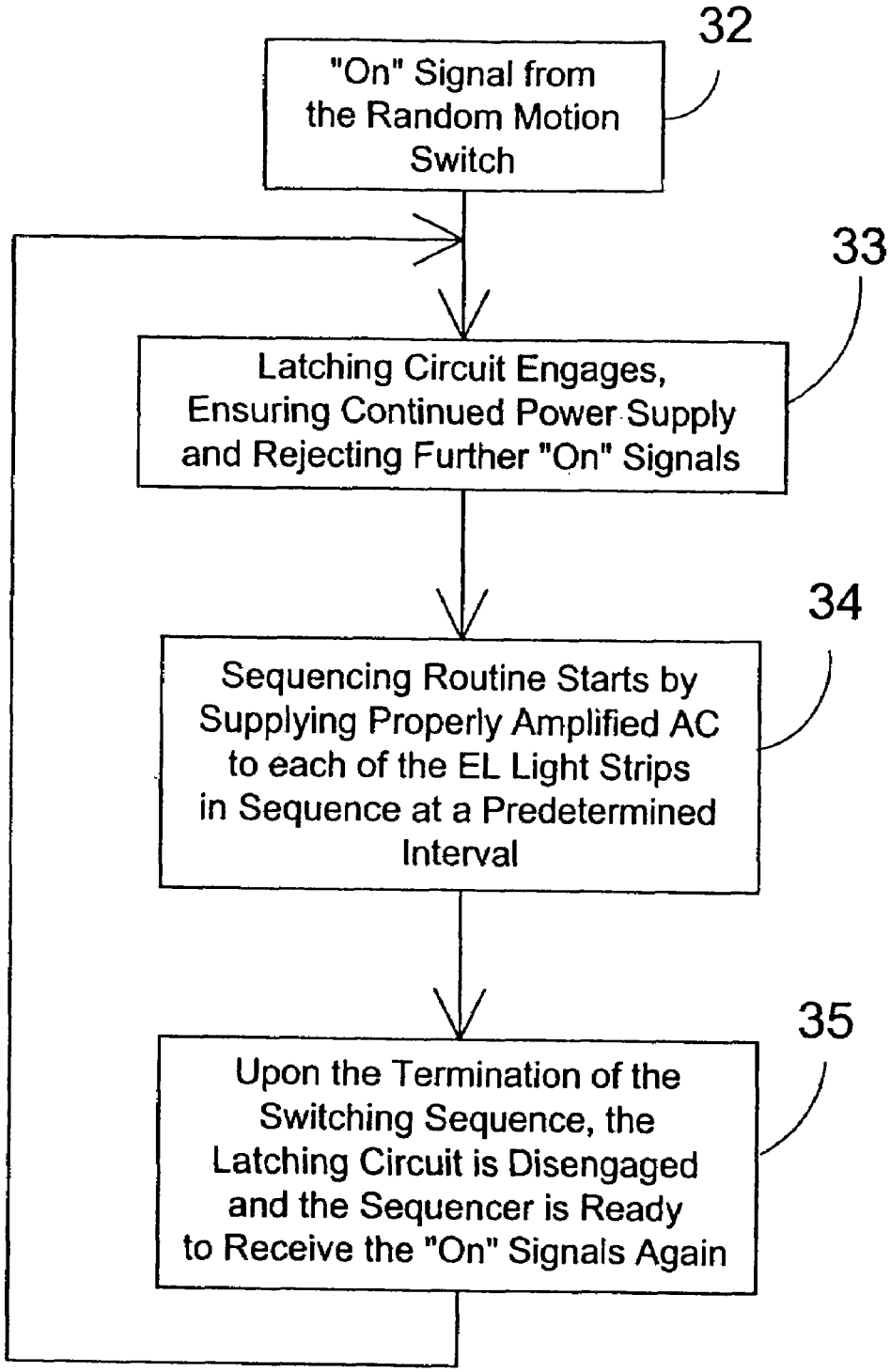
FIG. 10 is a block diagram of the function of a sequencer circuit.

FIG. 10 is a block diagram of the function of a preferred embodiment of a sequencer circuit. A sequencer turns a series of pre-assigned EL strips on and off in sequence by supplying proper ac voltage to each of the EL strips selectively. In step 32 an "on" signal is received by a sequencer from a random motion switch. In step 33, while a sequencer is engaged in the switching routine, a latching circuit holds the sequencer's power supplied in an active state while blocking out any further "on" signals from the random motion switch. In step 34, the sequencing routine starts by supplying properly amplified AC current to each of the EL light strips in sequence and at a predetermined time interval. In step 35, the latching operation is disengaged at the end of the sequencing routine at which time the sequencer is ready to receive another "on" signal from the random motion switch.

Figure 11:
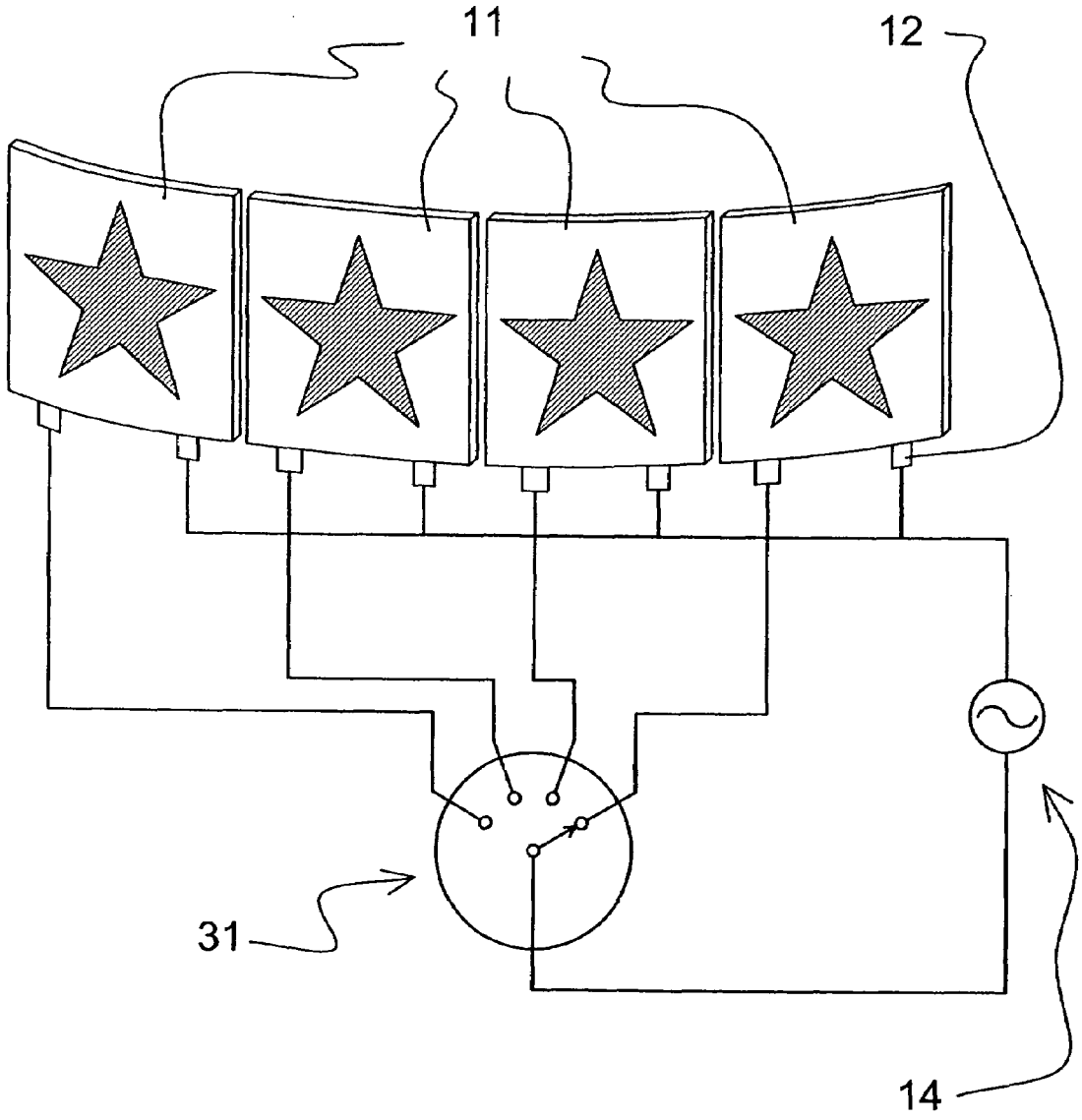
FIG. 11 is an illustration of an alternative use of the random motion switch.

FIG. 11 is an illustration of one embodiment of random motion switch 31. Individual EL star graphic light strips 11 are depicted directly connected to random motion switch 31 without the use of the intermediate sequencers. This makes the lighting of the EL strips completely random. Random motion switch 31 may be configured to send power source 14 voltages in serial fashion, thereby creating the illusion of motion. Random motion switch 31 may also be configured to turn on more than one EL strip at once for various other effects. Random motion switch 31 connects power source to one electrode 12 of EL star graphic light strip while the other electrode 12 is directly connected to power source 14. It should be noted that although random motion switch 31 is shown with four outputs feeding four EL light strips, the design can easily be expanded to any multiple of random motion switch outputs (or multiple of random motion switches) and EL light strips.

Figure 12:
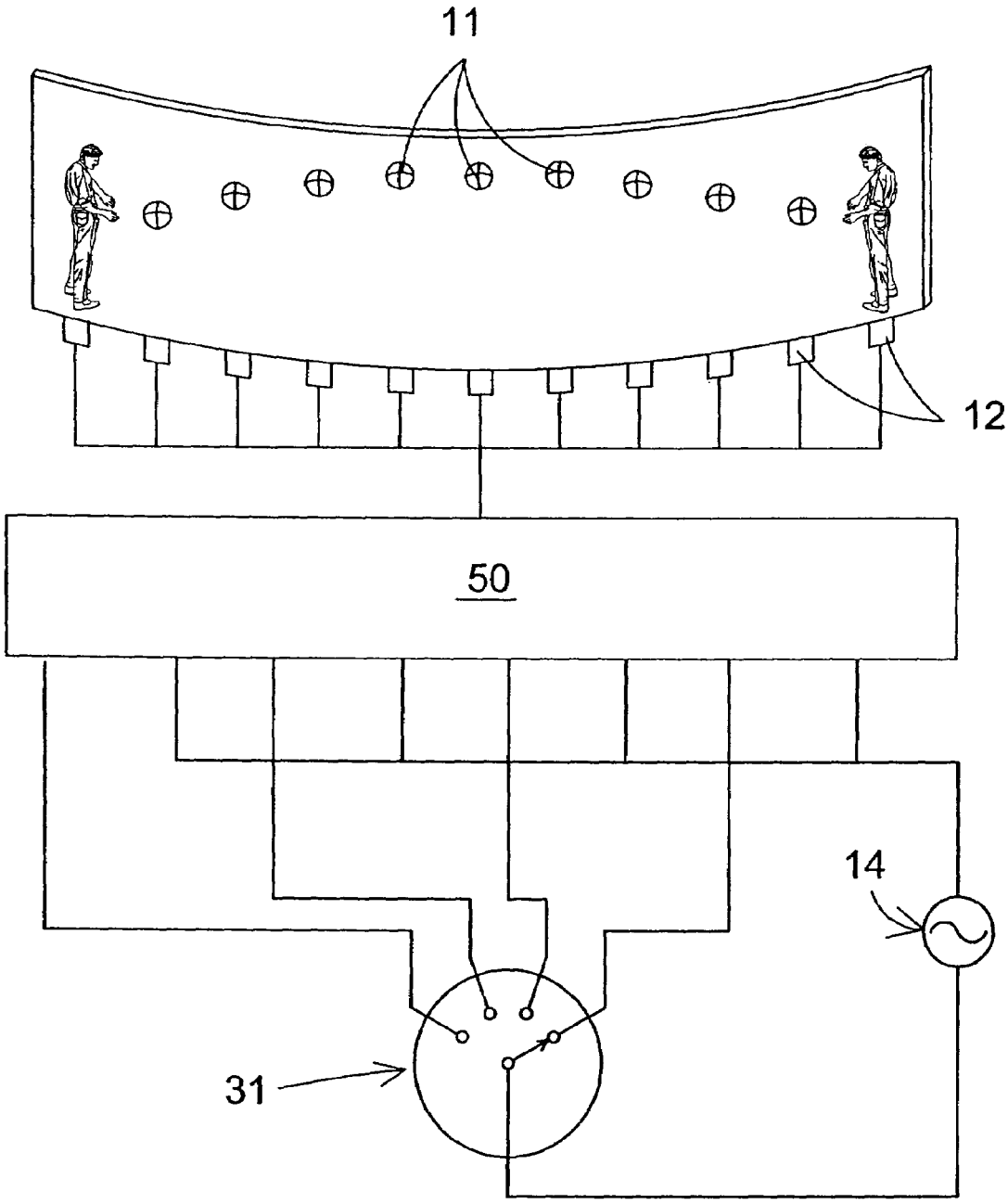
FIG. 12 is an illustration of another alternative use of the random motion switch.

FIG. 12 is an illustration of another embodiment of random motion switch 31 wherein switch 31 is connected to function interpreter 50 that energizes a series of predetermined switching routines bringing power 14 to EL strips via sequencer outputs. The function interpreter 50 provides power source 14 to a series of electrodes 12 of EL graphic light strip. Each of the four random contacts of switch 31 signals function interpreter 50, based on the predetermined signal of each contact received, the function interpreter 50 may illuminate artwork 11 in sequence in a predetermined direction, thereby giving the appearance of animation motion in various flash directions. As illustrated, the artwork 11 would appear that two people were playing catch. Once a routine is finished, function interpreter 50 would be ready to be initiated again by random motion switch 31.

Figure 13:
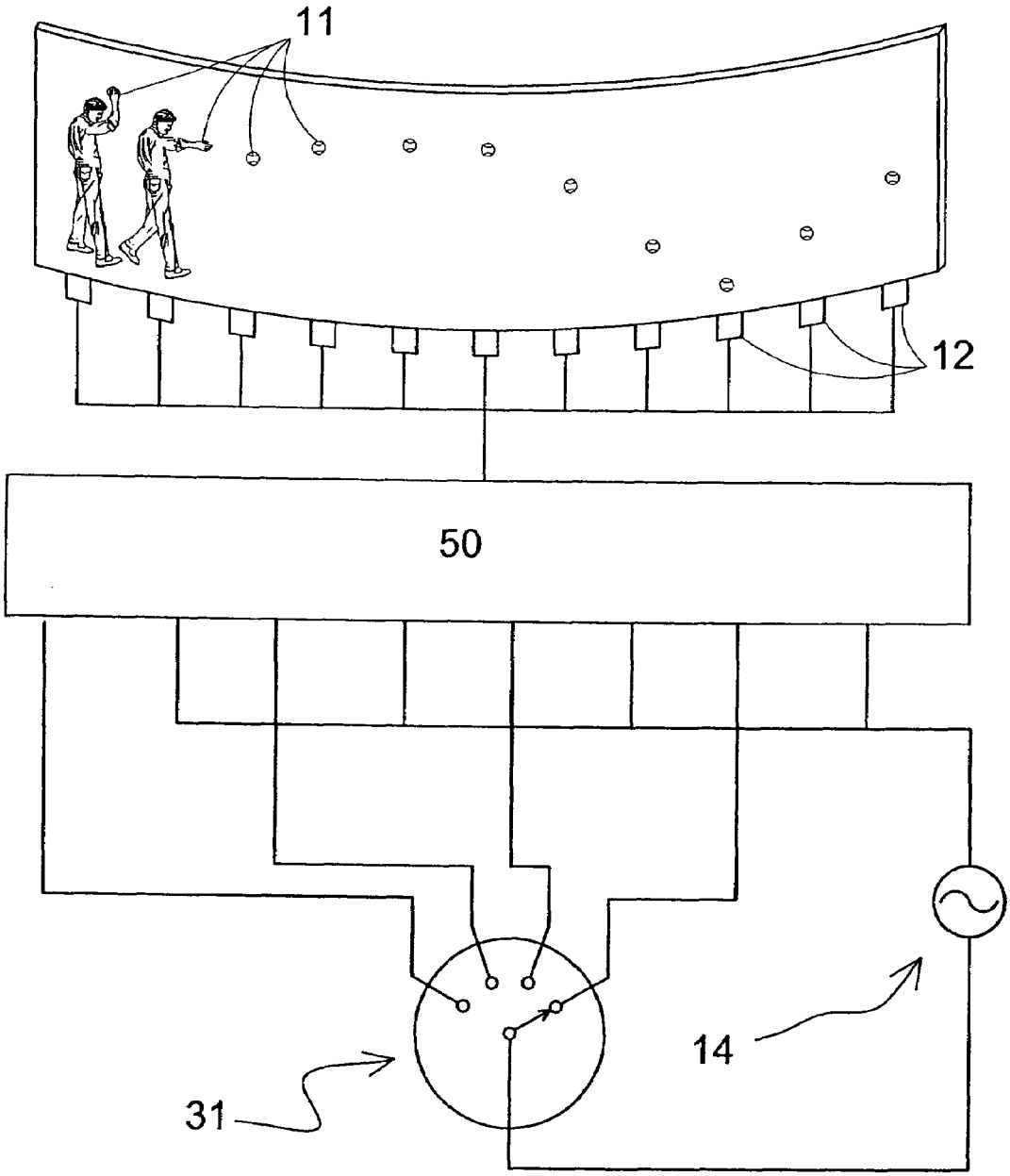
FIG. 13 is an illustration of another alternative use of the random motion switch.

FIG. 13 is an illustration of another embodiment of random motion switch 31 wherein switch 31 is connected to function interpreter 50 that energizes a series of predetermined switching routines bringing power 14 to EL strips via sequencer outputs. Function interpreter 50 provides power source 14 to a series of electrodes 12 of EL graphic light strip. Each of the four random contacts of switch 31 signals function interpreter 50, based on the predetermined signal of each contact received, function interpreter 50 will illuminate the artwork 11 in sequence in a predetermined direction, thereby giving the appearance of animation motion in various speeds. As illustrated, artwork 11 would appear that a person is moving and throwing a ball. Once a routine is finished, function interpreter 50 would be ready to be initiated again by the random motion switch 31.

Figure 14:
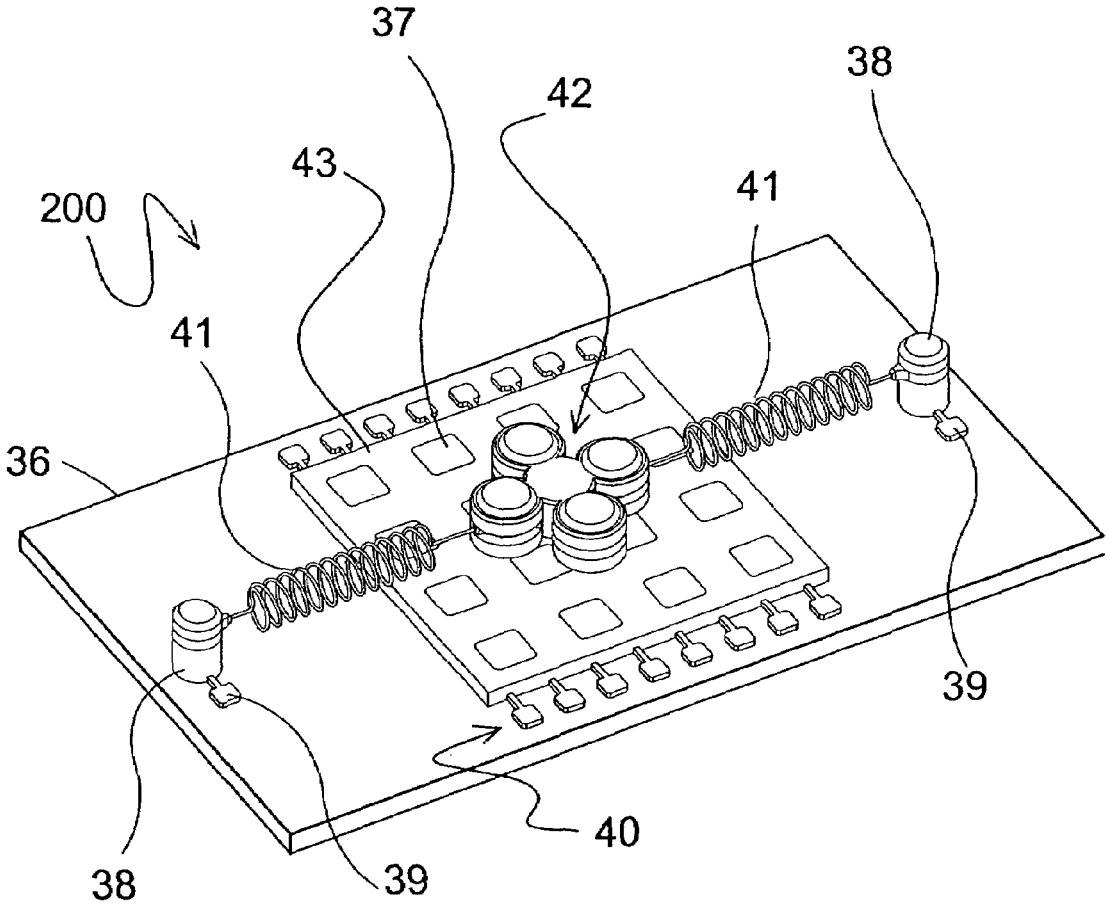
FIG. 14 is a perspective view of a random orbiter motion pressure switch.

FIG. 14 is an illustration of a perspective view of random orbiter motion pressure switch 200. In operation, power is brought into random orbiter motion pressure switch 200 at each of two power-in electrode 39 points which are, in turn, connected to each of two spring anchors 38 located on each side of non-conductive base plate 36. Power continues to each of two orbiter springs 41 which are, in turn, electrically connected to orbiter 42. At the bottom (not shown) of orbiter 42 is a spring-loaded contact electrode (orbiter contact shoe), which is in constant contact with one of a multiple of distribution plates 37. Distribution plates 37 each extend through non-conductive base plate 36 and are connected via conductor lines to respective power-out electrodes 39. Thus, at least one power-out electrode is activated depending on the position of orbiter 42. Orbiter 42 is basically an electrically conductive weight, which is constrained by a number of springs 41 that constrain orbiter 42 to move about on distribution plate 43 as motion is applied to random orbiter motion pressure switch 200. This motion of the orbiter 42 results in random contacts between contact plates 37 on distribution plate 43 and orbiter 42 by way of the orbiter contact shoe, which can be seen below in FIG. 15, thereby closing the circuit between the power-in electrodes 39 and the power-out electrodes 40 that are connected to an EL light strip (or a sequencer). Thus, full electrical conduction is maintained between power-in electrodes 39, orbiter 42 through orbiter contact shoe and power-out electrodes 40. It should be noted that random orbiter motion pressure switch 200 may easily be applied to clothing as to footwear as simple motion activates the movement of the switch position. It should be noted that non-conductive base plate 36 and distribution plate 43 may be manufactured as one entity using available circuit card technology. Random orbiter motion pressure switch 200 in conjunction with a power source and EL's, can be easily packaged to an article of footwear, clothing, back pack, bicycle frame or any variety of objects that are set into motion.

Figure 15:
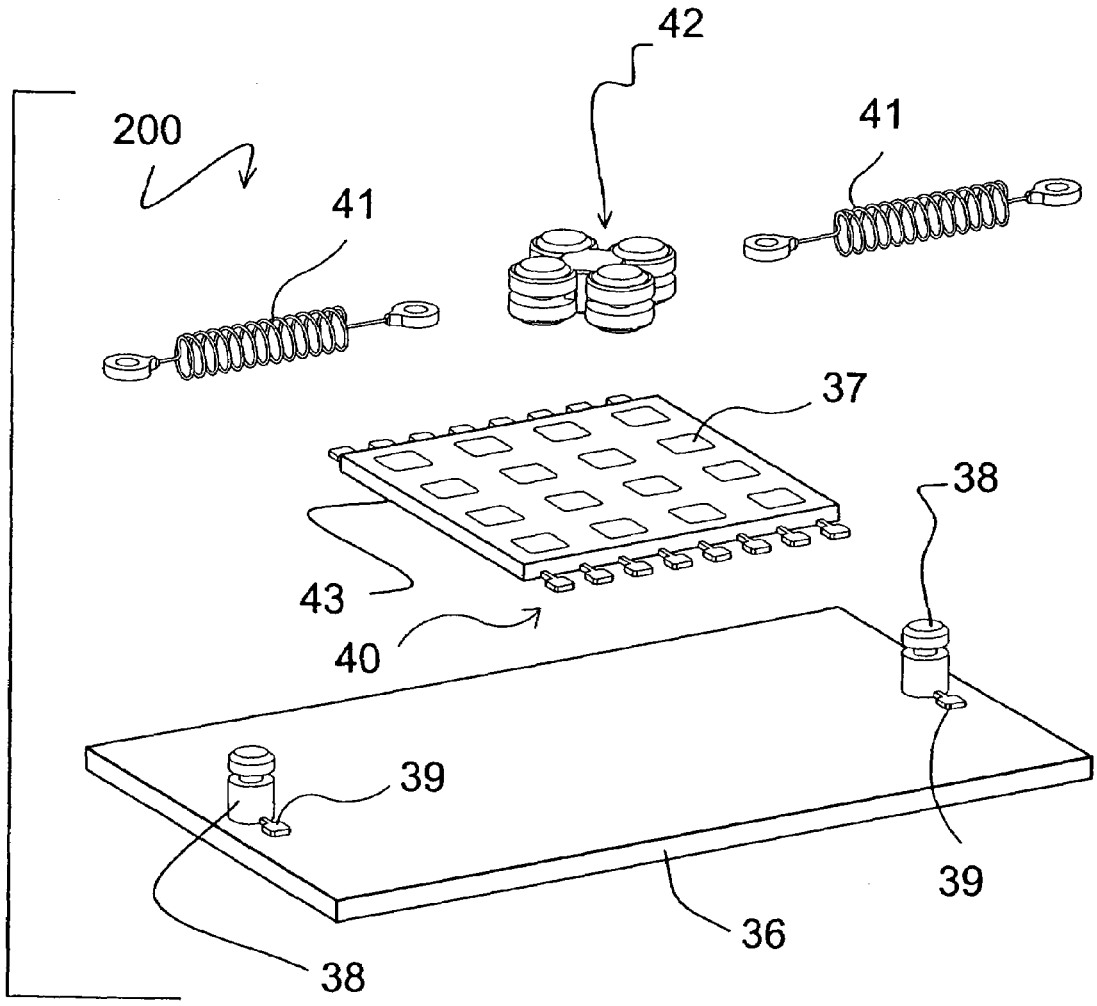
FIG. 15 is an exploded view of another random orbiter motion pressure switch.

FIG. 15 is an exploded view of random orbiter motion pressure switch 200. Two main components are orbiter 42 and distribution plate 43. Base plate 36 provides the area on which these elements are assembled. The entire orbiter motion pressure switch 200 may be encased in a housing. Such a housing (not shown) may contain the top surface of orbiter 42 and prevent orbiter 42 from bouncing off the surface of distribution plate 43. Also shown are base plate 36 that may contain spring anchors 38 and power-in electrodes 39. Distribution plate 43 may include contact plates 37 and power-out electrodes 40. Orbiter springs 41 connect to spring anchors 38 at one end and to orbiter 42 at the other end and constrain movement of orbiter 42 over distribution plate 43.

Figure 16:
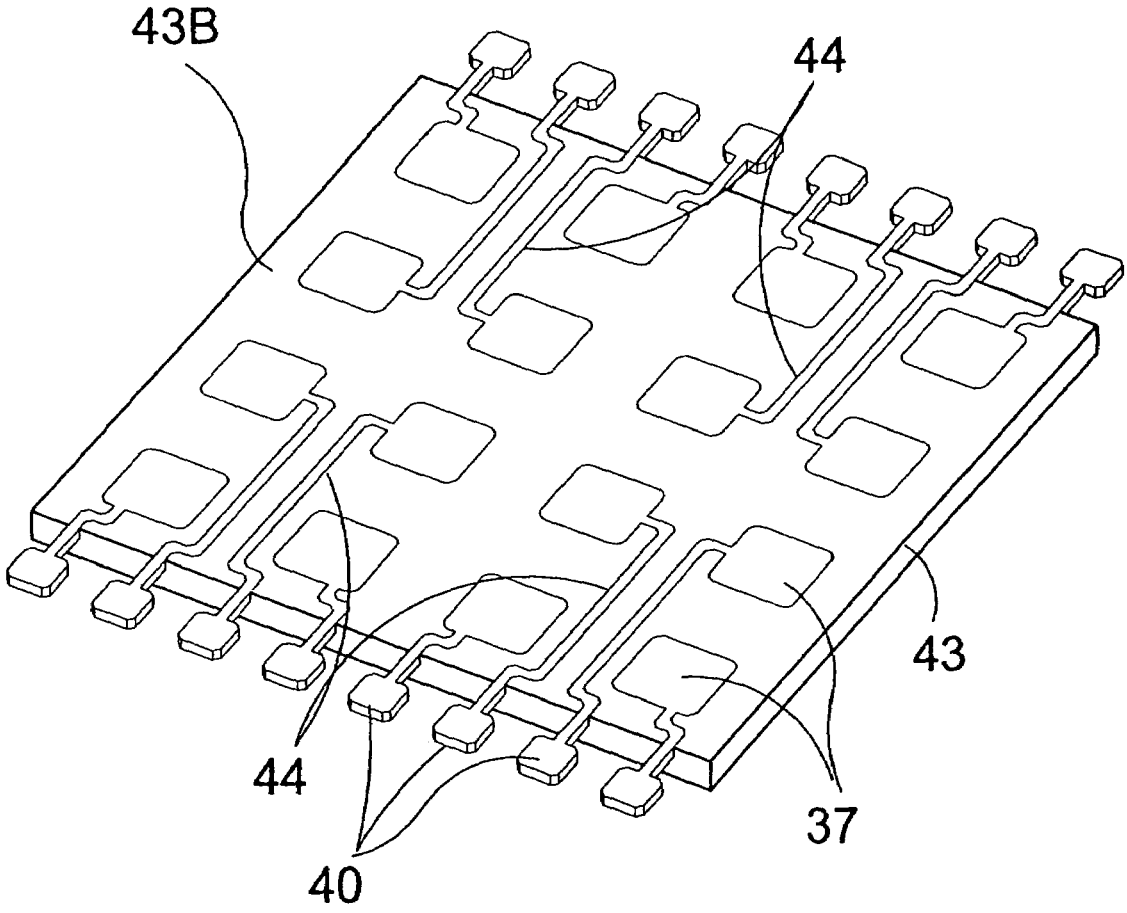
FIG. 16 is a bottom perspective view of the distribution plate.

FIG. 16 is a bottom perspective view of distribution plate 43. The bottom view of distribution plate 43 shows that every contact plate 37 extends through distribution plate 43 to distribution plate bottom surface 43 and are connected to a power-out electrode 40 via surface printed circuit connections 44. Each of the power-out electrodes 40 can be connected to an EL light strip of a group for which the particular random motion switch is assigned. Alternatively, each one of the power-out electrodes 40 can be connected to a sequencer, which is, in turn, connected to a group of EL light strips.

Figure 17:
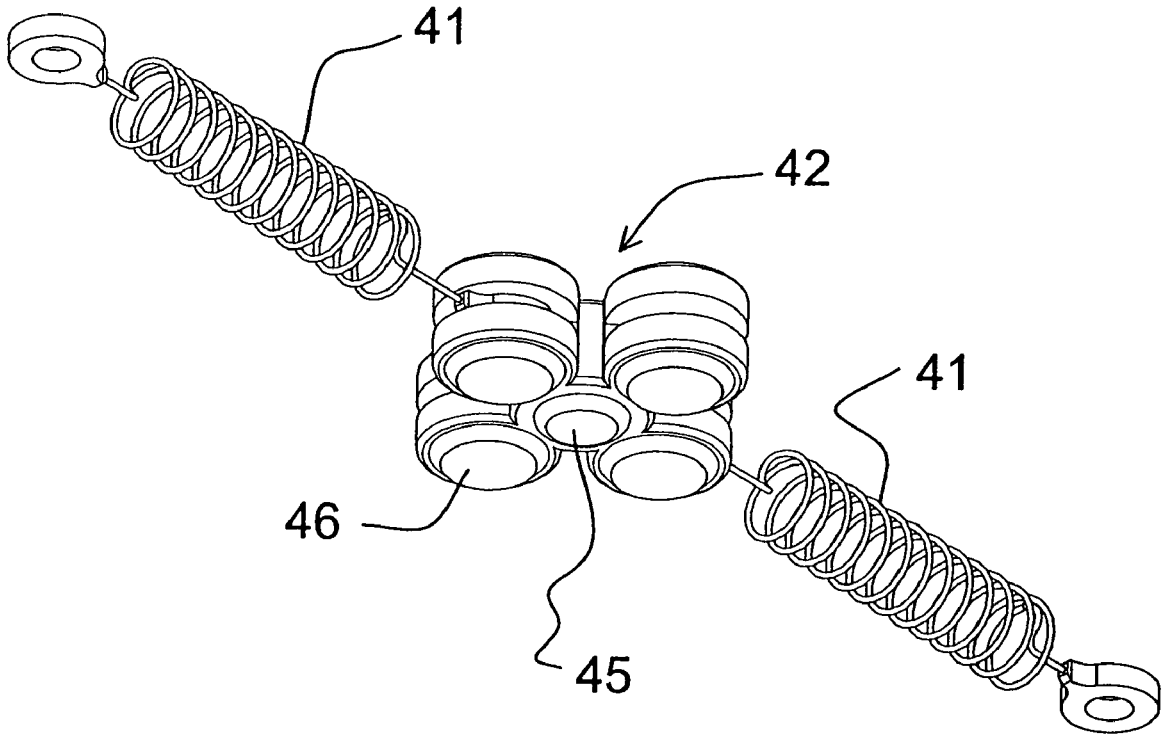
FIG. 17 is a lower front perspective view of the orbiter assembly.

FIG. 17 is a lower front perspective view of orbiter 42 assembly. Orbiter contact shoe 45 is an electrode that is spring loaded (see FIG. 16) to make contact with the contact plates 37 (not shown) on distribution plate 43 (not shown). The spring load ensures full electrical conduction when these electrodes (orbiter 42 and contact plate 37) come into physical contact. The force of the internal orbiter contact shoe spring (see FIG. 16) on orbiter contact shoe 45 is small enough that it will not hinder the free movement of orbiter 42 itself. Orbiter 42 is supported and constrained by friction shoes 46 at the bottom as well as at the top. Friction shoes 46 are typically made of non-conductive materials that reduce the friction and provide wearabilty. However, ff friction shoes 46 are made of conductive material, then orbiter 42 may contact more contact plates and may simultaneously power more EL's.

Figure 18:
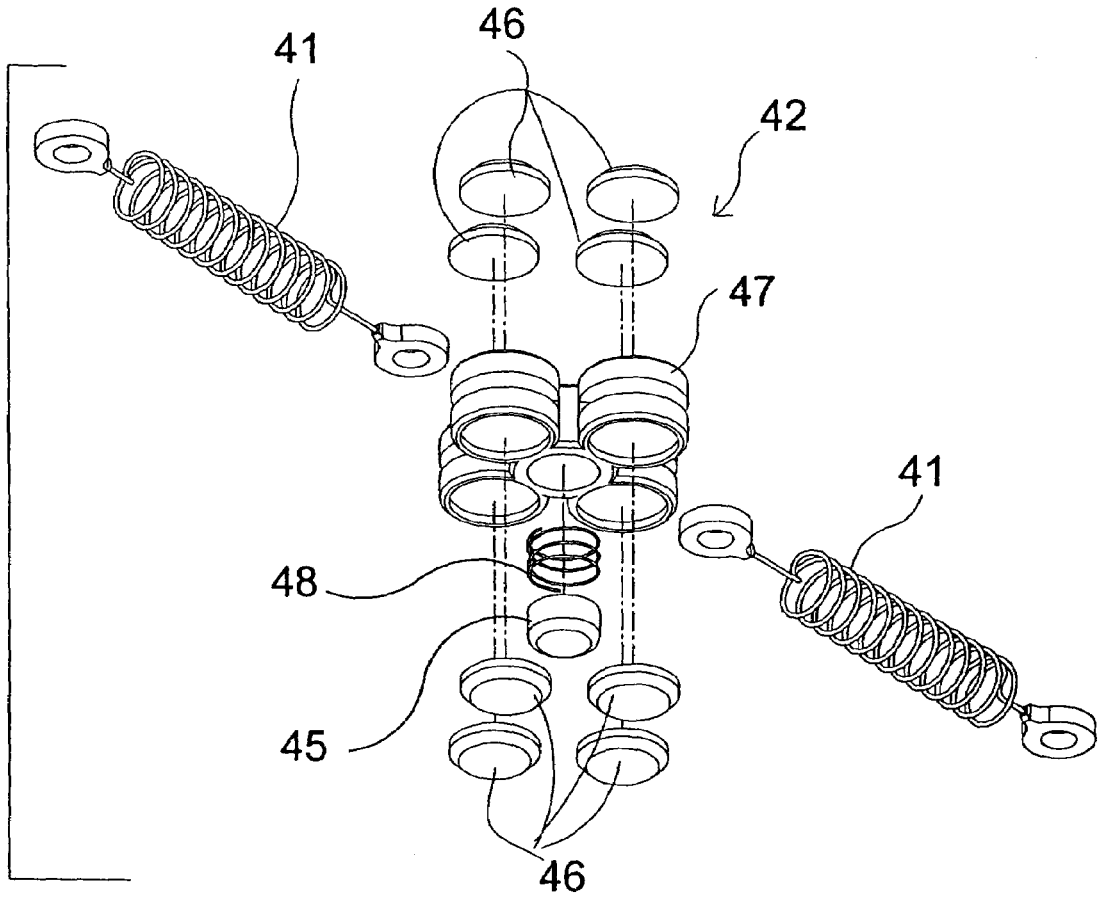
FIG. 18 is an exploded view of the orbiter assembly.

FIG. 18 is an exploded view of the orbiter 42 assembly. Orbiter 42 assembly may include four upper friction shoes 46 and four lower friction shows 46, which are all attached to orbiter frame 47. Orbiter contact shoe is housed within orbiter frame 47 and spring loaded via orbiter contact shoe internal spring 48. Orbiter contact shoe internal spring 48 ensures maximum conduction when orbiter contact shoe 45 makes physical contact with contact plates 37 (not shown) on distribution plate 43 (not shown). Orbiter springs 41 may be pivotally engaged to orbiter 42, allowing orbiter's free movement within the distribution plate. Upper orbiter contact shoes 46 may engage the lower surface of an encased housing (not shown) and prevent orbiter 42 from bouncing off the surface of distribution plate 43.

Figure 19:
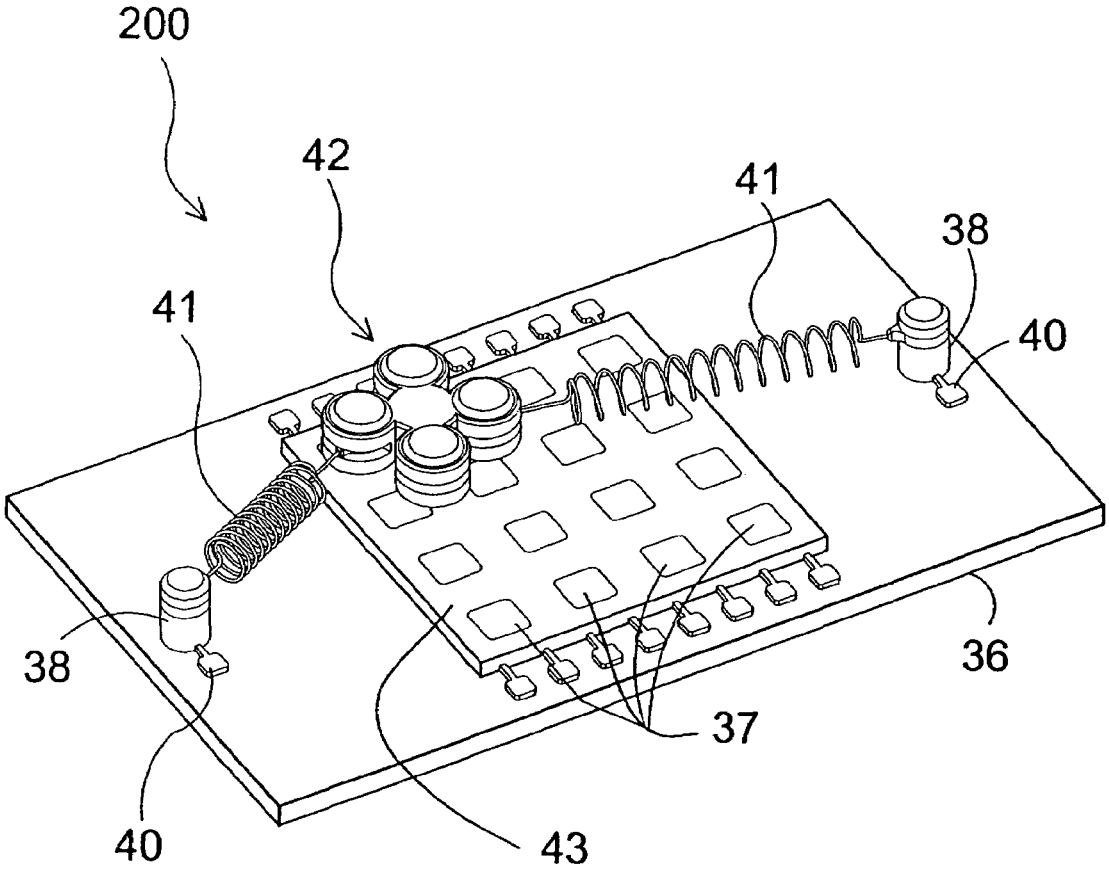
FIG. 19 is a perspective view of a random orbiter motion pressure switch in operation.

FIG. 19 is an illustration of a perspective view of orbiter motion pressure switch 200 in operation. FIG. 19 shows orbiter 42 in movement to a non-central position on distribution plate 43. Orbiter springs 41 provide restoring forces, urging orbiter 42 toward the center of distribution plate 43. As orbiter 42 picks up momentum from the movement of a wearer, the combined kinetic and potential energy keeps orbiter 42 in constant motion about distribution plate 43. The random motion switch may be configured in a variety of ways. For example, orbiter 42 may be constrained within the area of distribution plate 43 without the use of orbiter springs 41. Orbiter 42 may also be constrained to move along a linear distribution plate for a linear sequencing. Orbiter 42 might also be constrained to pivot around a point. The orbiter contact shoe can have various sizes so that it can make simultaneous multiple contacts with any number of contact plates 37 on distribution plate 43.

Figure 20:
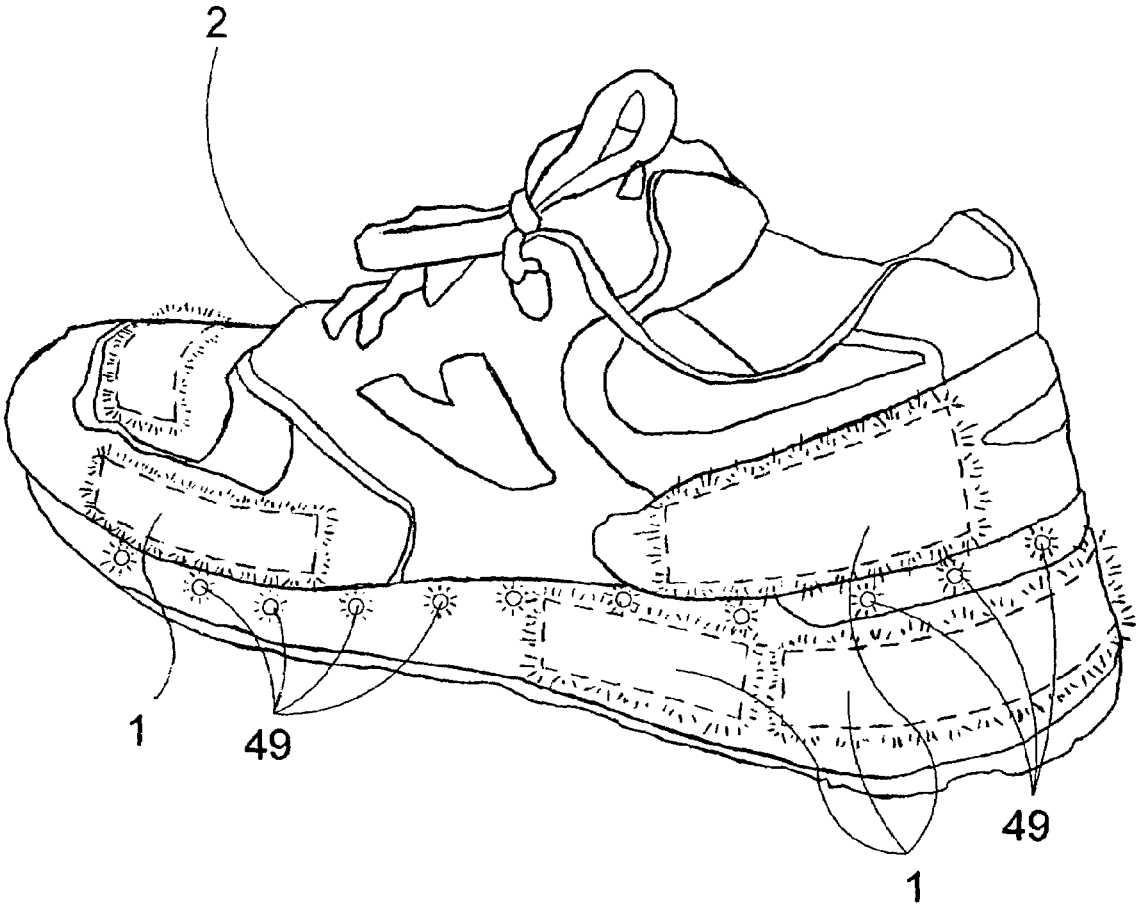
FIG. 20 is a perspective view of the electro-luminescent shoe with supplemental LED's.

FIG. 20 is perspective view of the electro-luminescent shoe with supplemental LED's lighting elements 49. The present invention may utilize EL light strips 1 in conjunction with LED lighting elements 49 for various display effects. The EL light strips and LED's may be used to create many different colors and shapes. The present invention may incorporate any combination of EL and LED lighting elements along with one or more of the switching elements.

Figure 21:
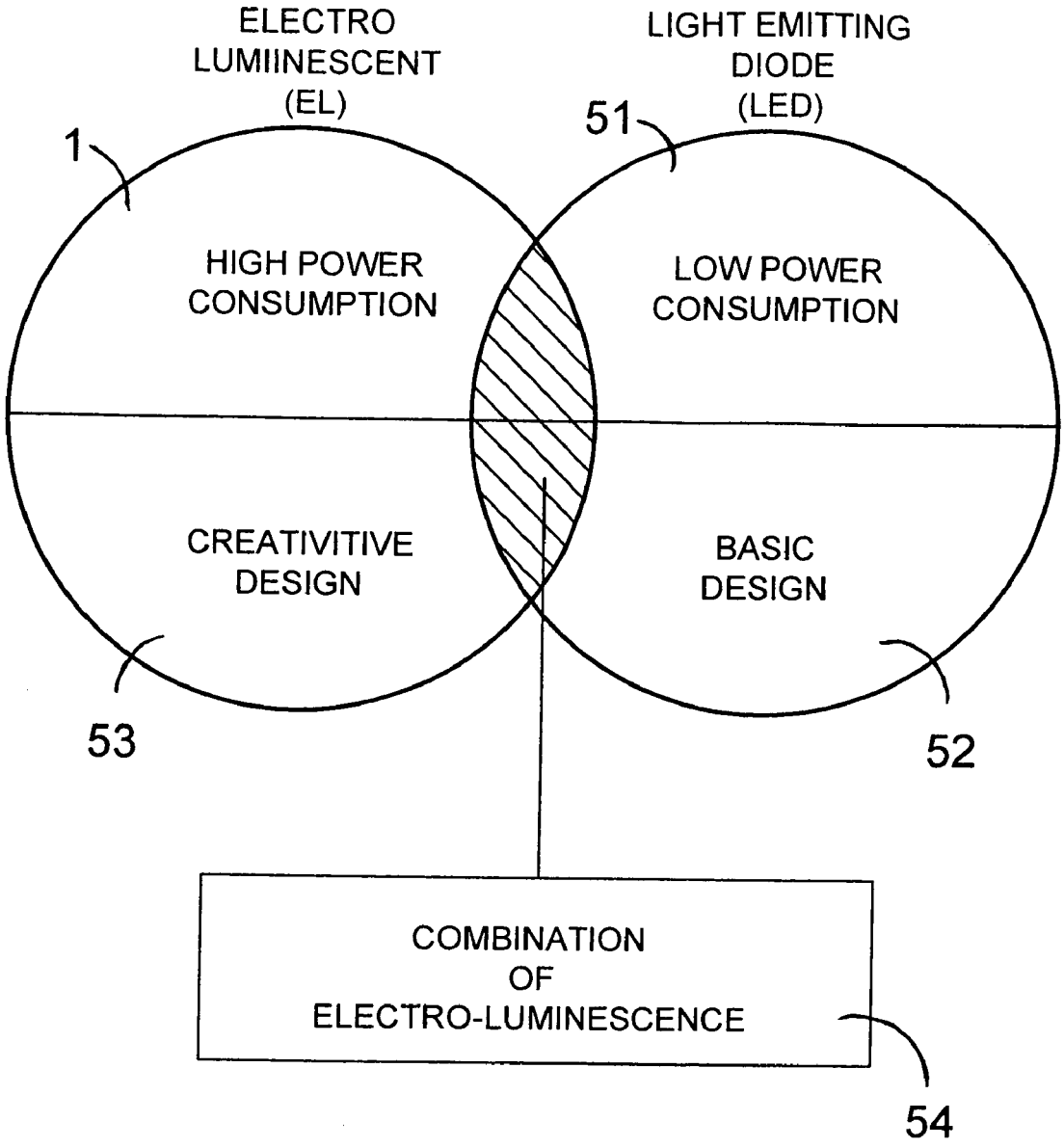
FIG. 21 is an illustrative diagram of lighting for the present invention.

FIG. 21 is an illustrative diagram of lighting for the present invention. The present invention incorporates the use of EL lighting strip 1 and LED lighting 51 in creating a lighting display for an article. The EL strip(s) 1 being thin and pliable is capable of being formed into creative designs 53 while the LED's are used in the more traditional methods 52 due to physical constraints. The two types of lighting are used to create a more decorative display 54 than is obtainable by using one or the other. The present invention considers that there are strengths and weakness to both, therefore creating a lighting display circuit 54 that will use each to its own advantage.

Figure 22:
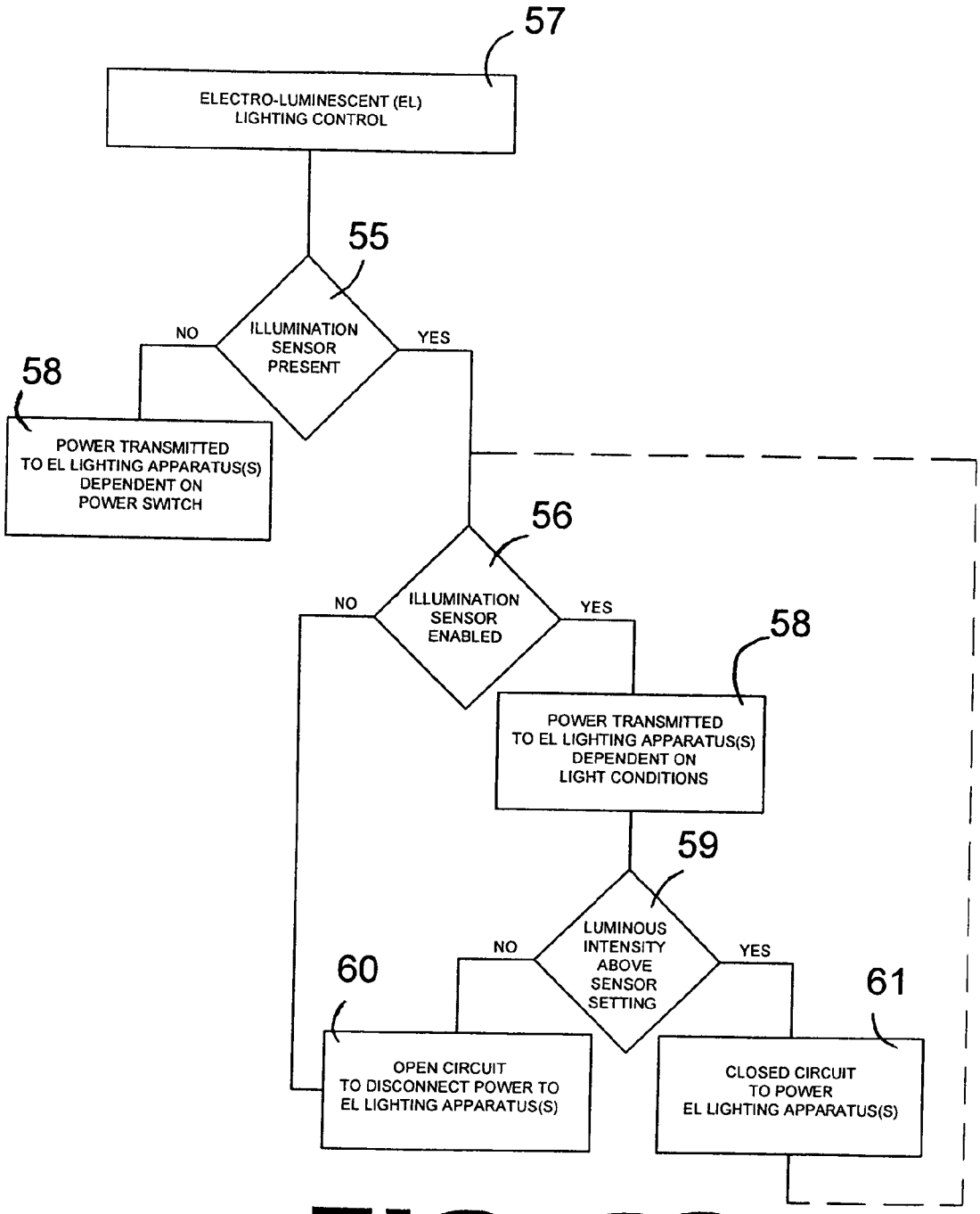
FIG. 22 is a flowchart of the logic circuit for the EL lighting strip(s).

FIG. 22 is a flowchart of the logic circuit for the EL lighting strip(s). As previously describes, EL lighting 1 has the advantage over LED lighting 51 in that the physical characteristics of EL lighting strips 1 being thin and pliable can be formed onto curved surfaces resulting in more creative displays 53, while LED lighting 51 has physical characteristics that limit its use but LEDs require much less voltage to operate. The present invention 54 uses a combination of EL lighting strips 1 and LED lighting 51 to produce a more robust lighting display 54 than is currently available using one or the other. The present invention 54 also proposes the optional use of a light sensor 55 to extend power source 14 life. As illustrated, the EL illumination 57 would occur upon a closed circuit 58 unless light-sensitive sensor 55 is present. If light sensor 55 is present and enabled 56, illumination would be determined by whether the ambient luminescence is above the sensor setting 59 which will result in a closed circuit illumination 61 or open circuit 60—not illuminated.

Figure 23:
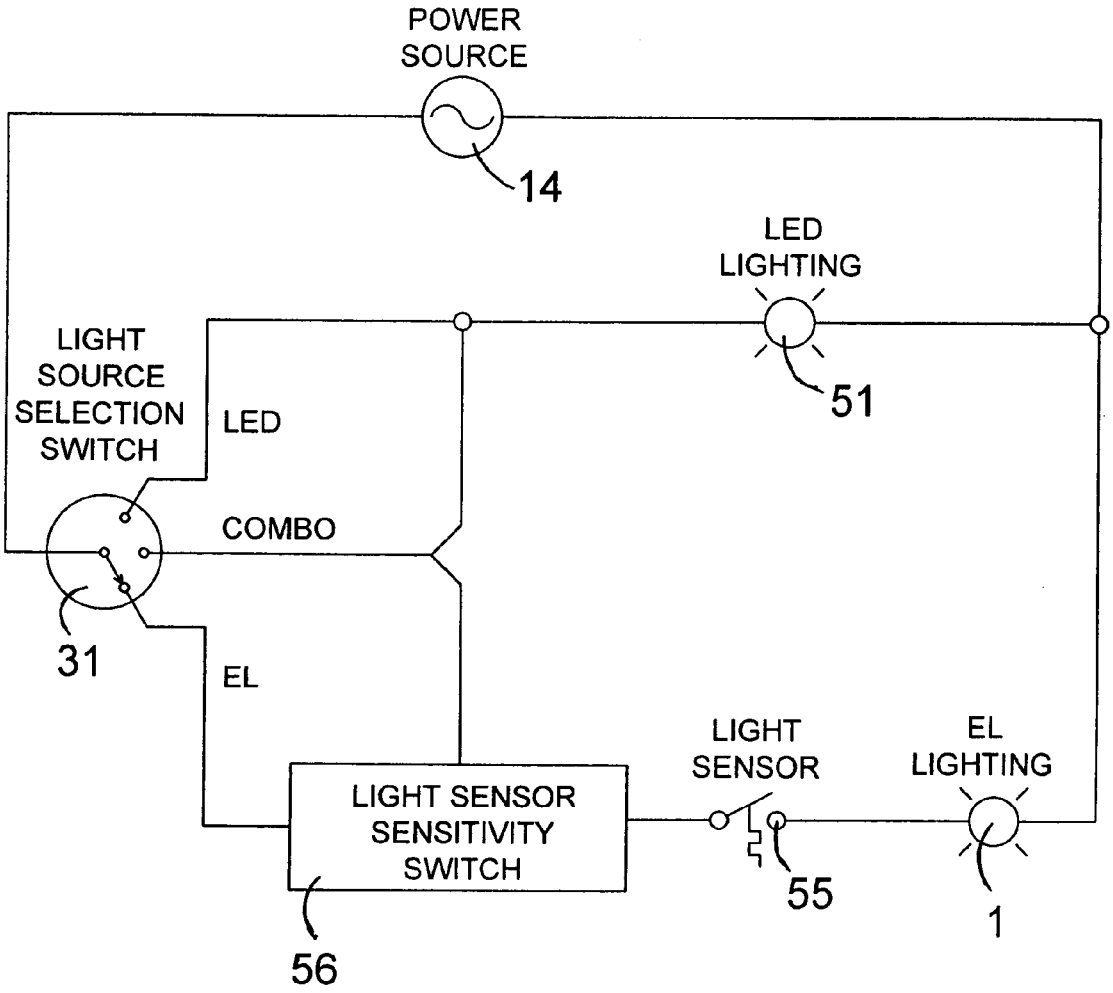
FIG. 23 is a schematic wiring diagram of the lighting circuit of the present invention.

FIG. 23 is a schematic wiring diagram of the lighting circuit of a preferred embodiment of the present invention. The lighting circuit having power source 14 in electrical communication with LEDs 51 and EL strips 1 illuminates the light generating elements 1, 51 based on a closed circuit generated through motion sensor 31 causing the lighting display 1, 51 or portion thereof to be illuminated. The circuit may also incorporated light sensor 51 and switch 56, which are incorporated not only to extend power supply life but more importantly not to illuminate the EL strip(s) 1 when the ambient luminescence would substantially prevent or overpower the visibility of the EL strip(s) 1.

Thus, an improved Electro-Luminescent system is provided. Moreover, it will be understood that the foregoing is only illustrative of the principles of the invention and that various modifications can be made by those skilled in the art without departing from the scope and spirit of the invention. Accordingly, such embodiments will be recognized as within the scope of the present invention.

Persons skilled in the art will appreciate that the present invention can be practiced by other than the described embodiments, which are presented for purposes of illustration rather than of limitation and that the present invention is limited only by the claims that follow.

What is claimed is:

1. An illuminated article comprising:

at least one electro-luminescent light strip having decorative indicia formed thereon;

at least one light-emitting diode; and an electronic circuit including at least one battery electrically connected to the light sources to power the at least one electro-luminescent light strip and the at least one light-emitting diode;

a direct-current to alternate-current inverter electrically positioned between the power supply and the electroluminescent light strip; and motion sensing means including a distribution plate having a plurality of contact pads, a plurality of springs including a first and a second end, and an orbiter having at least one conductive shoe; wherein the distribution plate is arranged between a base plate and the orbiter, the first end of each spring is coupled to the orbiter and the second end of each spring being anchored to the base plate at an opposite side of the distribution plate;

the motion sensing means forming a switch for turning the electro-luminescent light strip and the light-emitting diode ON and OFF by the orbiter moving over the distribution plate in reaction to motion of the illuminated article.

2. The article of claim 1 wherein said article is footwear.

3. The article of claim 1 wherein said article is clothing.

4. The article of claim 1 wherein said article is headwear.

5. The article of claim 1, wherein the motion sensor means includes a first conductive.contact and a plurality of second conductive contacts, and wherein movement of the motion sensor means causes random contact between the first conductive contact and at least one second conductive contact causing a closed circuit between the power supply and the second conductive contact thereby illuminating the electro-luminescent light strip and the light-emitting diode.

6. The article of claim 5, further comprising at least one motion responsive mechanical member having two distal ends, wherein one distal end is connected to a static structure and the other distal end is connected to the first conductive contact.

7. The article of claim 6, wherein movement of said motion sensor means causes the motion responsive member to move in response to movement causing random contact between the first conductive contact and at least one of the second conductive contacts.

8. The article of claim 7, wherein the motion responsive mechanical member is a spring.

9. The article of claim 1, further comprising a means for sensing ambient light luminescence.

10. The article of claim 9, wherein the means for sensing ambient light luminescence includes a lightsensitive sensor.

11. The article of claim 10, wherein the light-sensitive sensor forms a switch that works in conjunction with the motion sensor means for engaging and disengaging the power supply of the electro-luminescent light strip.

12. The article of claim 11, wherein the lightsensitive sensor causes an open circuit for the electro-luminescent light strip upon sensing ambient light luminescence above a predetermined value.

13. The article of claim 11, wherein the lightsensitive sensor switch causes a closed circuit for the electro-luminescent light strip upon sensing ambient light luminescence below a predetermined value. motion responsive mechanical member is a spring.

14. An illuminated article comprising:

a plurality of electro-luminescent light strips having decorative indicia formed thereon;

at least one light-emitting diode;

an electronic circuit including at least one battery electrically connected to the light sources to power the plurality of electro-luminescent light strip and the at least one light-emitting diode;

a direct-current to alternate-current inverter electrically positioned between the power supply and the electroluminescent light strip;

motion sensing means including a distribution plate having a plurality of contact pads, a plurality of springs including a first and a second end, and an orbiter having at least one conductive shoe; wherein the distribution plate is arranged between a base plate and the orbiter, the first end of each spring is coupled to the orbiter and the second end of each spring being anchored to the base plate at an opposite side of the distribution plate;

the motion sensing means forming a switch for turning the electro-luminescent light strip and the light-emitting diode ON and OFF by the orbiter moving over the distribution plate in reaction to motion of the illuminated article;

a sequencer that turns on and off a series of pre-assigned electro-luminescent light strips in a predetermined sequence for a predetermined time interval by selectively supplying alternating-current voltage to each of the plurality of electro-luminescent light strips; and a latching circuit that provides power, to the sequencer for a predetermined time interval while blocking any further signals from the motion sensing means during the predetermined time interval, wherein the latching circuit is disengaged at the end of the predetermined time interval.

15. The article of claim 1 wherein said article is footwear.

16. The article of claim 14 wherein said article is clothing.

17. The article of claim 14 wherein said article is headwear.

18. The article of claim 14, wherein the motion sensor means includes a first conductive contact and a plurality of second conductive contacts, and wherein movement of the motion sensor means causes random contact between the first conductive contact and at least one second conductive contact causing a closed circuit between the power supply and the second conductive contact thereby illuminating the electro-luininescent light strip and the light-emitting diode.

19. The article of claim 18, further comprising at least one motion responsive mechanical member having two distal ends, wherein one distal end is connected to a static structure and the other distal end is connected to the first conductive contact.

20. The article of claim 19, wherein movement of said motion sensor means causes the motion responsive member to move in response to movement causing random contact between the first conductive contact and at least one of the second conductive contacts.

21. The article of claim 20, wherein the motion responsive mechanical member is a spring.

22. The article of claim 14, further comprising a means for sensing ambient light luminescence.

23. The article of claim 22, wherein the means for sensing ambient light luminescence includes a light-sensitive sensor.

24. The article of claim 23, wherein the light-sensitive sensor forms a switch that works in conjunction with the motion sensor means for, engaging and disengaging the power supply of the electro-luminescent light strip.

25. The article of claim 24, wherein the light-sensitive sensor causes an open circuit for the electro-luminescent light strip upon sensing ambient light luminescence above a predetermined value.

26. The article of claim 24, wherein the light-sensitive sensor switch causes a closed circuit for the electro-luminescent light strip upon sensing ambient light luminescence below a predetermined value.

27. An illuminated article comprising:

at least one electro-luminescent light strip having decorative indicia formed thereon;

at least one light-emitting diode;

an electronic circuit including at least one battery electrically connected to the light sources to power the at least one electro-luminescent light strip and the at least one light-emitting diode;

a direct-current to alternate-current inverter electrically positioned between the power supply and the electro-luminescent light strip;

motion sensing means including a distribution plate having a plurality of contact pads, a plurality of springs including a first and a second end, and an orbiter having at least one conductive shoe; wherein the distribution plate is arranged between a base plate and the orbiter, the first end of each spring is coupled to the orbiter and the second end of each spring being anchored to the base plate at an opposite side of the distribution plate;

the motion sensing means forming a switch for turning the electro-luminescent light strip and the light-emitting diode ON and OFF by the orbiter moving over the distribution plate in reaction to motion of the illuminated article; and a means for sensing ambient light luminescence.

28. The article of claim 27 wherein said article is footwear.

29. The article of claim 27 wherein said article is clothing.

30. The article of claim 27 wherein said article is headwear.

31. The article of claim 27, wherein the means for sensing ambient light luminescence includes a light-sensitive sensor.

32. The article of claim 31, wherein the light-sensitive sensor forms a switch that works in conjunction with the motion sensor means for engaging and disengaging the power supply of the electro-luminescent light strip.

33. The article of claim 31, wherein the light-sensitive sensor causes an open circuit for the electro-luminescent light strip upon sensing ambient light luminescence above a predetermined value.

34. The article of claim 31, wherein the light-sensitive sensor switch causes a closed circuit for the electro-luminescent light strip upon sensing ambient light luminescence below a predetermined value.

35. The article of claim 27, wherein the motion sensor means includes a first conductive contact and a plurality of second conductive contacts, and wherein movement of the motion sensor means causes random contact between the first conductive contact and at least one second conductive contact causing a closed circuit between the power supply and the second conductive contact thereby illuminating the electro-luminescent light strip and the light-emitting diode.

36. The article of claim 35, further comprising at least one motion responsive mechanical member having two distal ends, wherein one distal end is connected to a static structure and the other distal end is connected to the first conductive contact.

37. The article of claim 36 wherein movement of said motion sensor means causes the motion responsive member to move in response to movement causing random contact between the first conductive contact and at least one of the second conductive contacts.

38. The article of claim 37 wherein the motion responsive mechanical member is a spring.

* * * * *

UNITED STATES PATENT AND TRADEMARK OFFICE

CERTIFICATE OF CORRECTION

PATENT NO. : 7,329,019 B2
APPLICATION NO. : 10/939134
DATED : February 12, 2008
INVENTOR(S) : James Cheung It is certified that error appears in the above-identified patent and that said Letters Patent is hereby corrected as shown below:

Title page Item [57] in the Abstract:

First line, delete “An” and insert --A--;

In the Specification:

Column 1, line 43, delete “that” and insert --than--;

Column 3, line 8, delete “El” and insert --EL--;

Column 5, line 56, delete “reftrred” and insert --referred--;

Column 6, line 60, delete “ac” and insert --AC--;

Column 8, line 60, delete “ff” and insert --if--;

Column 9, line 28, insert --a-- after “is”;
line 50, delete “describes” and insert --described--;

Column 10, line 8, delete “incorporated” and insert --incorporate--;

In the Claims:

Claim 10, line 10, delete “lightsensitive” and insert --light-sensitive--;

Claim 12, line 15, delete “lightsensitive” and insert --light-sensitive-

Claim 13, line 19, delete “lightsensitive” and insert --light-sensitive--;
line 23, delete “motion responsive mechanical member is a spring”;

UNITED STATES PATENT AND TRADEMARK OFFICE

CERTIFICATE OF CORRECTION

PATENT NO. : 7,329,019 B2
APPLICATION NO. : 10/939134
DATED : February 12, 2008
INVENTOR(S) : James Cheung It is certified that error appears in the above-identified patent and that said Letters Patent is hereby corrected as shown below:

In the Claims (continued):

Claim 14, lines 33-34, delete “electrolu-minescent” and insert --electro-luminescent--.

Signed and Sealed this

Ninth Day of June, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,329,019 B2
APPLICATION NO. : 10/939134
DATED : February 12, 2008
INVENTOR(S) : James Cheung It is certified that error appears in the above-identified patent and that said Letters Patent is hereby corrected as shown below:

Title page Item [57] in the Abstract:

First line, delete “An” and insert --A--;

In the Specification:

Column 1, line 43, delete “that” and insert --than--;

Column 3, line 8, delete “El” and insert --EL--;

Column 5, line 56, delete “reftrred” and insert --referred--;

Column 6, line 60, delete “ac” and insert --AC--;

Column 8, line 60, delete “ff” and insert --if--;

Column 9, line 28, insert --a-- after “is”;
line 50, delete “describes” and insert --described--;

Column 10, line 8, delete “incorporated” and insert --incorporate--;

In the Claims:

Column 11, Claim 10, line 10, delete “lightsensitive” and insert --light-sensitive--;

Column 11, Claim 12, line 15, delete “lightsensitive” and insert --light-sensitive--;

Column 11, Claim 13, line 19, delete “lightsensitive” and insert --light-sensitive--;
line 23, delete “motion responsive mechanical member is a spring”;

UNITED STATES PATENT AND TRADEMARK OFFICE

CERTIFICATE OF CORRECTION

PATENT NO. : 7,329,019 B2
APPLICATION NO. : 10/939134
DATED : February 12, 2008
INVENTOR(S) : James Cheung It is certified that error appears in the above-identified patent and that said Letters Patent is hereby corrected as shown below:

In the Claims (continued):

Column 11, Claim 14, lines 33-34, delete "electrolu-minescent" and insert --electro-luminescent--.

This certificate supersedes the Certificate of Correction issued June 9, 2009.

Signed and Sealed this

Seventh Day of July, 2009

John Doll

JOHN DOLL
*Acting Director of the United States Patent and Trademark Office*